US011269288B2

(12) United States Patent
Sato

(10) Patent No.: US 11,269,288 B2
(45) Date of Patent: Mar. 8, 2022

(54) PROCESS CARTRIDGE

(71) Applicant: Brother Kogyo Kabushiki Kaisha, Nagoya (JP)

(72) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/328,112

(22) Filed: May 24, 2021

(65) Prior Publication Data

US 2021/0278800 A1 Sep. 9, 2021

Related U.S. Application Data

(63) Continuation of application No. 16/844,176, filed on Apr. 9, 2020, now Pat. No. 11,029,639, which is a (Continued)

(30) Foreign Application Priority Data

Sep. 4, 2017 (JP) ..... JP2017-169559

(51) Int. Cl.
*G03G 21/18* (2006.01)
*G03G 21/00* (2006.01)
(Continued)

(52) U.S. Cl.
CPC ..... *G03G 21/1814* (2013.01); *G03G 15/0806* (2013.01); *G03G 21/0005* (2013.01);
(Continued)

(58) Field of Classification Search
CPC ..... G03G 21/1814; G03G 21/1817; G03G 21/1821; G03G 21/1825
See application file for complete search history.

(56) References Cited

U.S. PATENT DOCUMENTS 5,028,966 A 7/1991 Kozuka et al.
6,728,500 B2 4/2004 Naito et al.
(Continued)

FOREIGN PATENT DOCUMENTS

JP 2003-066815 A 3/2003
JP 2010-256806 A 11/2010
(Continued)

OTHER PUBLICATIONS

Jul. 27, 2021—(JP) Notice of Reasons for Refusal—App 2017-169559.

*Primary Examiner* — Carla J Therrien
(74) *Attorney, Agent, or Firm* — Banner & Witcoff, Ltd.

(57) ABSTRACT

A process cartridge includes: a drum cartridge including a photosensitive drum; and a toner cartridge which is mountable on the drum cartridge and stores toner, wherein the drum cartridge includes: a cleaner configured to collect waste toner on the photosensitive drum; a waste toner conveyance tube configured to convey the waste toner collected by the cleaner; and a developing unit which includes a developing roller configured to supply toner to the photosensitive drum and is swingable about a swing axis with respect to the photosensitive drum, and wherein the toner cartridge has a waste toner storing chamber for storing the waste toner conveyed by the waste toner conveyance tube.

14 Claims, 18 Drawing Sheets

Related U.S. Application Data continuation of application No. 16/393,399, filed on Apr. 24, 2019, now Pat. No. 10,649,398, which is a continuation of application No. 15/935,367, filed on Mar. 26, 2018, now Pat. No. 10,303,115.

(51) Int. Cl.

| | |
|---|---|
| ***G03G 21/12*** | (2006.01) |
| ***G03G 21/10*** | (2006.01) |
| ***G03G 15/08*** | (2006.01) |

(52) U.S. Cl.

CPC ..... *G03G 21/0011* (2013.01); *G03G 21/105* (2013.01); *G03G 21/12* (2013.01); *G03G 21/1821* (2013.01)

(56) References Cited

U.S. PATENT DOCUMENTS

| | | | | |
|---|---|---|---|---|
| 6,792,230 | B2 | 9/2004 | Saito et al. | |
| 7,228,089 | B2 | 6/2007 | Saito et al. | |
| 2003/0039484 | A1 | 2/2003 | Naito et al. | |
| 2009/0180802 | A1 | 7/2009 | Sato et al. | |
| 2009/0214257 | A1 | 8/2009 | Kweon et al. | |
| 2010/0202803 | A1* | 8/2010 | Sato | G03G 15/0886 399/263 |
| 2010/0256806 | A1 | 10/2010 | Lin et al. | |
| 2010/0272474 | A1 | 10/2010 | Sato | |
| 2012/0213566 | A1* | 8/2012 | Sato | G03G 21/12 399/358 |
| 2012/0213567 | A1* | 8/2012 | Sato | G03G 21/105 399/358 |
| 2014/0037340 | A1 | 2/2014 | Sato | |
| 2014/0186071 | A1 | 7/2014 | Sato | |
| 2015/0050042 | A1 | 2/2015 | Sato et al. | |
| 2015/0147088 | A1 | 5/2015 | Sato et al. | |
| 2015/0261173 | A1 | 9/2015 | Sato | |
| 2016/0291528 | A1 | 10/2016 | Hashimoto et al. | |
| 2017/0285566 | A1 | 10/2017 | Shimizu et al. | |
| 2017/0285567 | A1 | 10/2017 | Fukaya et al. | |
| 2017/0285568 | A1 | 10/2017 | Nishiyama et al. | |
| 2018/0095418 | A1 | 4/2018 | Sato et al. | |
| 2018/0267459 | A1 | 9/2018 | Sato et al. | |
| 2018/0373197 | A1 | 12/2018 | Sato et al. | |
| 2019/0361384 | A1* | 11/2019 | Sato | G03G 21/1604 |

FOREIGN PATENT DOCUMENTS

| | | |
|---|---|---|
| JP | 2011-017939 A | 1/2011 |
| JP | 2015-175936 A | 10/2015 |

* cited by examiner

PROCESS CARTRIDGE

CROSS-REFERENCE TO RELATED APPLICATION

This application is a continuation of and claims priorities from U.S. patent application Ser. No. 16/844,176 filed Apr. 9, 2020 which is a continuation of U.S. patent application Ser. No. 16/393,399 filed Apr. 24, 2019, issued as U.S. Pat. No. 10,649,398 which is a continuation of U.S. patent application Ser. No. 15/935,367 filed Mar. 26, 2018, issued as U.S. Pat. No. 10,303,115 on May 28, 2019, and from Japanese Patent Application No. 2017-169559 filed on Sep. 4, 2017, the entire subject matters of which are incorporated herein by reference.

TECHNICAL FIELD

The present disclosure relates to a process cartridge.

BACKGROUND

In the related art, there has been known a process cartridge including a drum unit having a photosensitive drum, and a toner cartridge mountable in the drum unit (for example, see JP-A-2003-066815).

The drum unit includes a developing unit having a developing roller, a cleaner for cleaning a photosensitive drum, and a waste toner conveyance tube. The toner cartridge has a toner storing chamber and a waste toner storing chamber. When the toner cartridge is mounted on the drum unit, the developing unit and the toner storing chamber are connected to each other and the waste toner conveyance tube and the waste toner storing chamber are connected to each other.

In the process cartridge disclosed in JP-A-2003-066815, the photosensitive drum and the developing roller are stored in a housing of the developing unit in a state of holding an arrange relation. That is, the developing roller is fixed to the photosensitive drum.

Therefore, when the photosensitive drum and the developing roller rotate, there is a case where a contact state of the developing roller with respect to the photosensitive drum is changed due to a deviation of an outer diameter of the developing roller and the like, for example.

SUMMARY

The present disclosure has been made in view of the above circumstances, and one of objects of the present disclosure is to provide a process cartridge capable of properly holding a contact state of a developing roller with respect to a photosensitive drum.

According to an illustrative embodiment of the present disclosure, there is provided a process cartridge including: a drum cartridge including a photosensitive drum; and a toner cartridge which is mountable on the drum cartridge and stores toner, wherein the drum cartridge includes: a cleaner configured to collect waste toner on the photosensitive drum; a waste toner conveyance tube configured to convey the waste toner collected by the cleaner; and a developing unit which includes a developing roller configured to supply toner to the photosensitive drum and is swingable about a swing axis with respect to the photosensitive drum, and wherein the toner cartridge has a waste toner storing chamber for storing the waste toner conveyed by the waste toner conveyance tube.

DETAILED DESCRIPTION

1. Overview of Process Cartridge 1

Figure 1:
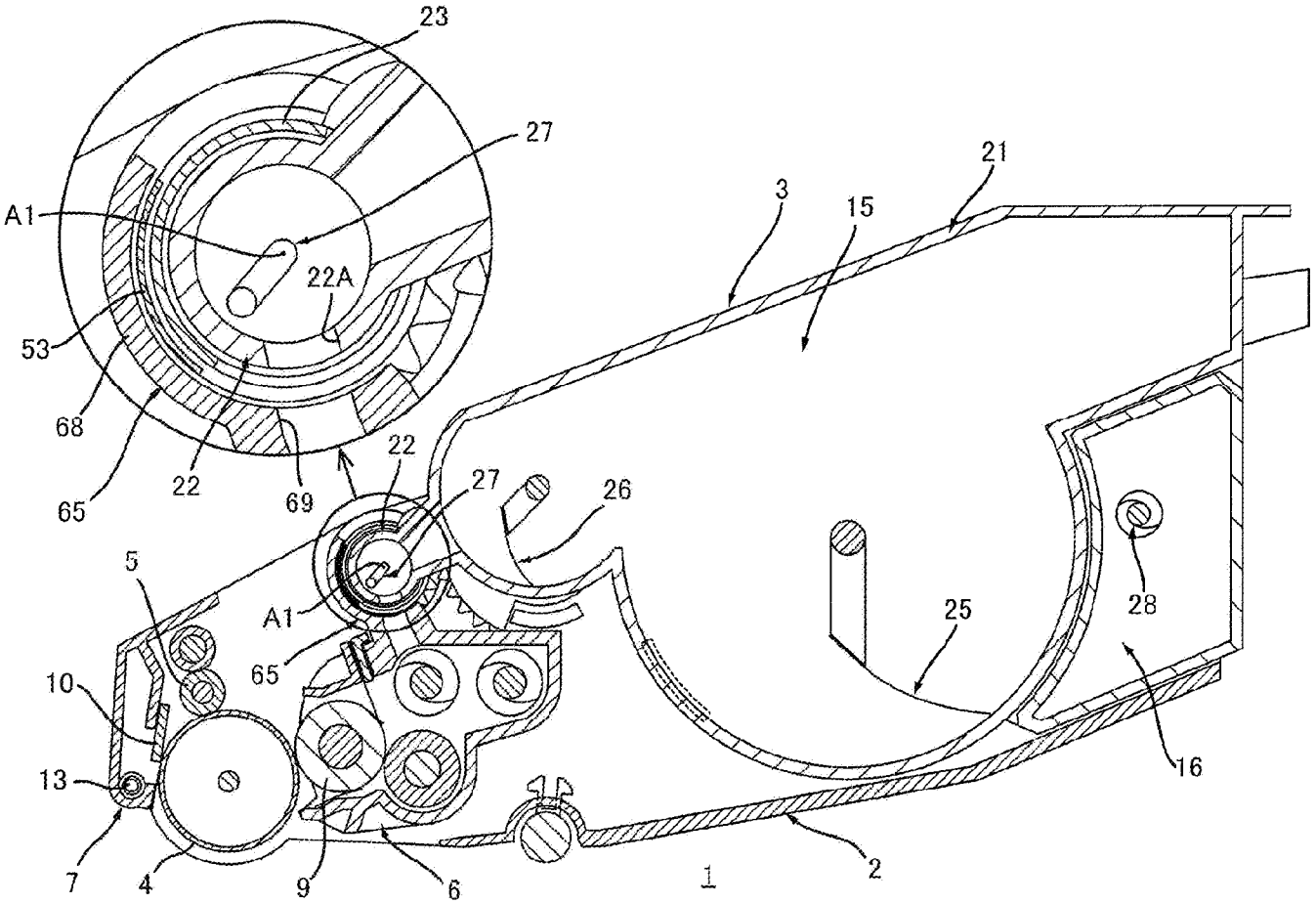
FIG. 1 is a sectional view taken along line I-I of a process cartridge of a first embodiment and the line I-I is illustrated in FIG. 3.

As illustrated in FIG. 1, the process cartridge 1 includes a drum cartridge 2 and a toner cartridge 3. The toner cartridge 3 is mountable on the drum cartridge 2.

1.1 Drum Cartridge 2

Figure 2:
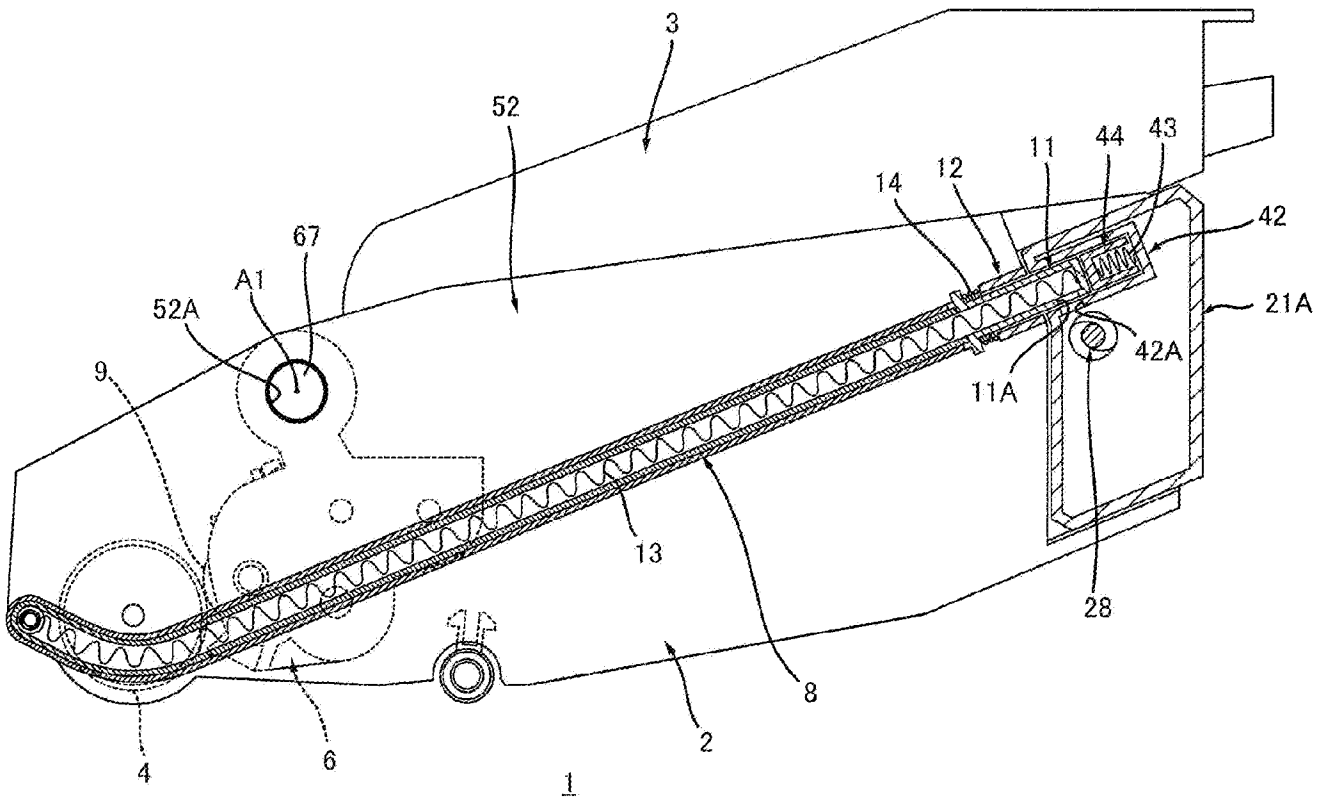
FIG. 2 is a sectional view of the process cartridge illustrated in FIG. 1 and illustrates a section passing through a waste toner conveyance tube.

The drum cartridge 2 includes a photosensitive drum 4, a charging roller 5, a developing unit 6, a cleaner 7, and a waste toner conveyance tube 8 (see FIG. 2).

1.1.1 Photosensitive Drum 4

The photosensitive drum 4 is configured to have a toner image formed on a surface thereof. The photosensitive drum 4 is rotatable about a rotational axis extending in an axial line direction.

1.1.2 Charging Roller 5

The charging roller 5 is configured to charge a peripheral surface of the photosensitive drum 4. The charging roller 5 contacts the peripheral surface of the photosensitive drum 4.

1.1.3 Developing Unit 6

The developing unit 6 is configured to supply toner to the photosensitive drum 4. Toner is supplied to the developing unit 6 from the toner cartridge 3 in a state where the toner cartridge 3 is mounted on the drum cartridge 2. The developing unit 6 includes a developing roller 9.

The developing roller 9 is configured to supply the toner in the developing unit 6 to the photosensitive drum 4. The developing roller 9 is positioned on a downstream side with respect to the charging roller 5 in a rotation direction of the photosensitive drum 4. The developing roller 9 contacts the peripheral surface of the photosensitive drum 4.

The developing unit 6 is swingable about a virtual swing axis A1 with respect to the photosensitive drum 4. The swing axis A1 extends in the axial line direction. Furthermore, the developing unit 6 is pressed by a spring (not illustrated) in a direction in which the developing roller 9 contacts the photosensitive drum 4. In this way, when the photosensitive drum 4 and the developing roller 9 rotate, the developing unit 6 swings about the virtual swing axis A1 with respect to the photosensitive drum 4 such that the developing roller 9 holds the state of properly contacting the surface of the photosensitive drum 4. The "state in which the developing roller 9 properly contacts the surface of the photosensitive drum 4" represents a state in which the developing roller 9 contacts the surface of the photosensitive drum 4 at proper pressure. The proper pressure is pressure for enabling the developing roller 9 to stably supply toner in the developing unit 6 to the photosensitive drum 4.

1.1.4 Cleaner 7

The cleaner 7 is configured to collect waste toner on the photosensitive drum 4. The cleaner 7 includes a cleaning blade 10.

The cleaning blade 10 is configured to remove the waste toner on the photosensitive drum 4. The cleaning blade 10 is positioned on a downstream side with respect to the developing roller 9 and on an upstream side with respect to the charging roller 5 in the rotation direction of the photosensitive drum 4. The cleaning blade 10 has a flat plate shape. The cleaning blade 10 contacts the peripheral surface of the photosensitive drum 4. When the photosensitive drum 4 rotates, the waste toner on the photosensitive drum 4 contacts the cleaning blade 10 and thus is removed from the peripheral surface of the photosensitive drum 4. The waste toner removed by the cleaning blade 10 is collected inside the cleaner 7.

1.1.5 Waste Toner Conveyance Tube 8

As illustrated in FIG. 2, the waste toner conveyance tube 8 is configured to convey the waste toner collected by the cleaner 7. The waste toner conveyance tube 8 has one end and the other end. The one end is connected to the cleaner 7 (see FIG. 1). The other end is connected to a socket 42 of the toner cartridge 3 in the state where the toner cartridge 3 is mounted on the drum cartridge 2. The socket 42 will be described later. The waste toner conveyance tube 8 includes a nozzle 11, a shutter 12, and a screw 13.

The nozzle 11 is positioned at the other end of the waste toner conveyance tube 8. The nozzle 11 is inserted into the socket 42 in the state where the toner cartridge 3 is mounted on the drum cartridge 2. The nozzle 11 extends in the mounting direction of the toner cartridge 3 with respect to the drum cartridge 2. The nozzle 11 has an opening 11A. The opening 11A can discharge the waste toner in the waste toner conveyance tube 8. The opening 11A communicates with an opening 42A of the socket 42 in the state where the nozzle 11 is inserted into the socket 42.

The shutter 12 is movable between an opened position (see FIG. 2) at which the opening 11A is opened and a closed position (not illustrated) at which the opening 11A is closed, with respect to the opening 11A. The shutter 12 is pressed toward the closed position by the spring 14 in a state of being positioned at the opened position. When the toner cartridge 3 is mounted on the drum cartridge 2, the shutter 12 moves from the closed position to the opened position against the pressing force of the spring 14 due to contact with the toner cartridge 3. When the toner cartridge 3 is detached from the drum cartridge 2, the shutter 12 moves from the opened position to the closed position by the pressing force of the spring 14.

The screw 13 is configured to convey toner remaining in the cleaner 7 to the opening 11A. The screw 13 is positioned inside the cleaner 7 and inside the waste toner conveyance tube 8.

1.2 Toner Cartridge 3

As illustrated in FIG. 1, the toner cartridge 3 can store toner. The toner cartridge 3 has a toner storing chamber 15 and a waste toner storing chamber 16.

1.2.1 Toner Storing Chamber 15

The toner storing chamber 15 stores toner. The toner in the toner storing chamber 15 is supplied to the developing unit 6 via a first connection part 22 and a second connection part 65, which will be described later, in the state where the toner cartridge 3 is mounted on the drum cartridge 2.

1.2.2 Waste Toner Storing Chamber 16

The waste toner storing chamber 16 stores the waste toner conveyed by the waste toner conveyance tube 8. The waste toner storing chamber 16 is partitioned from the toner storing chamber 15. The waste toner storing chamber 16 does not communicate with the toner storing chamber 15.

2. Details of Toner Cartridge 3

Figure 3:
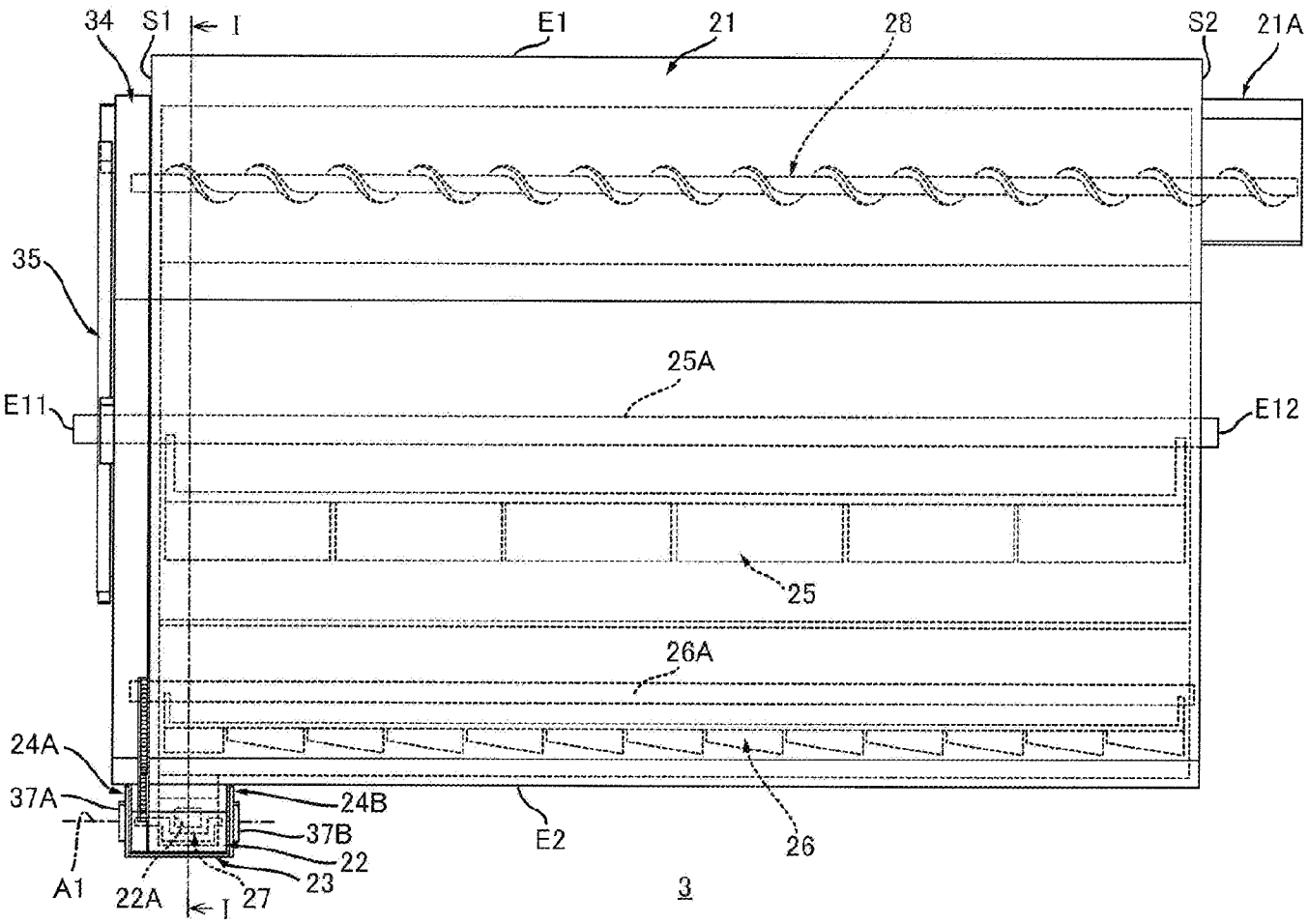
FIG. 3 is a plan view of a toner cartridge illustrated in FIG. 1.
Figure 4:
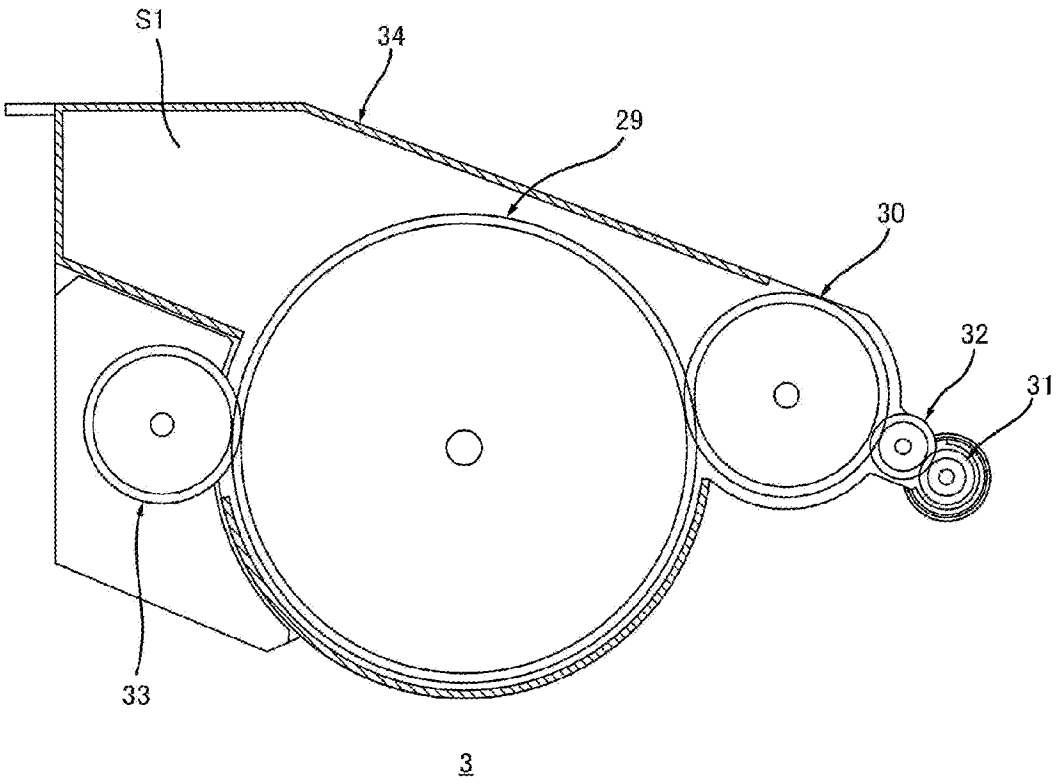
FIG. 4 is a sectional view of the toner cartridge illustrated in FIG. 3 and illustrates a section passing through a gear cover.
Figure 5:
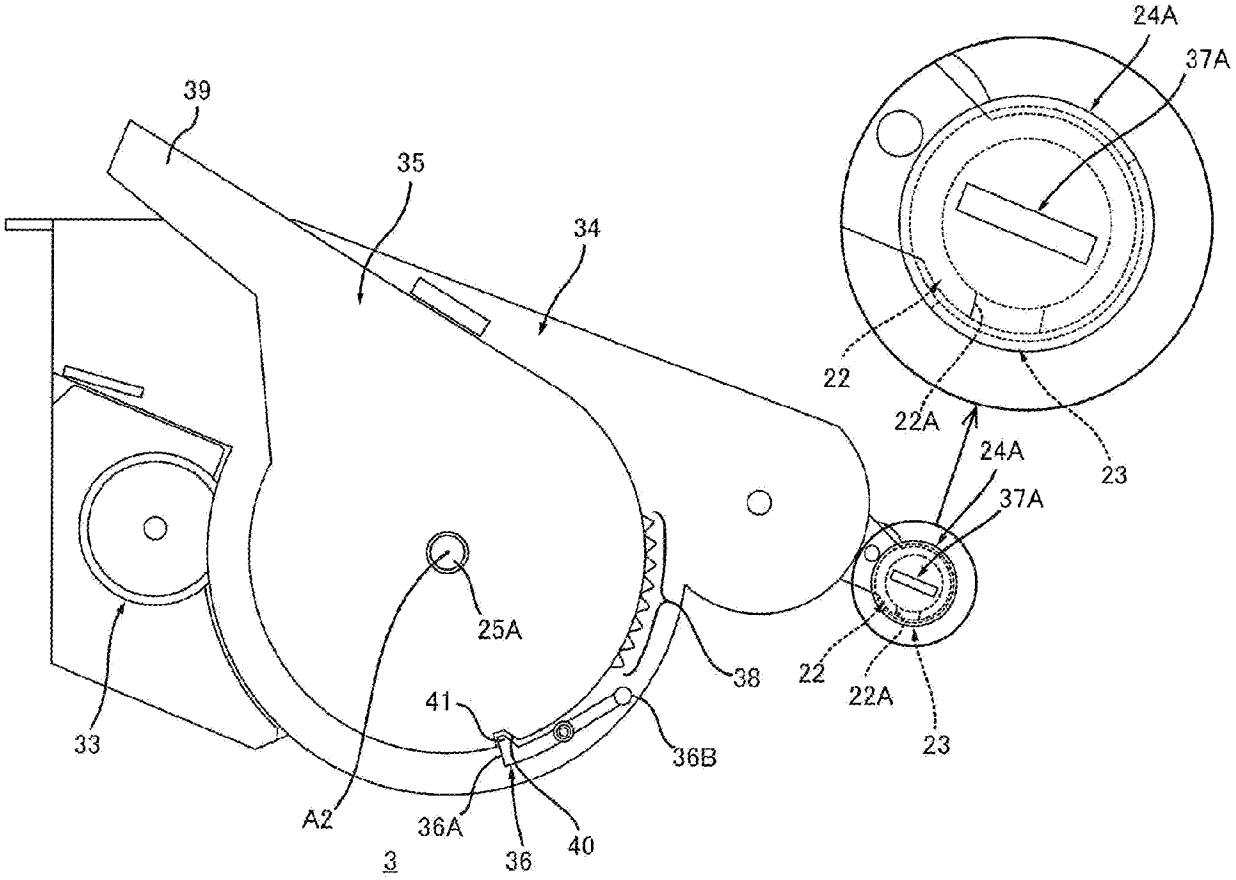
FIG. 5 is a side view of the toner cartridge illustrated in FIG. 3.

As illustrated in FIG. 1 and FIG. 3, the toner cartridge 3 includes a toner frame 21, the first connection part 22, a first shutter 23, two disks 24A and 24B (see FIG. 3), a plurality of agitators 25, 26, and 27, a screw 28, a plurality of agitator gears 29, 30, and 31 (see FIG. 4), an idle gear 32 (see FIG. 4), a screw gear 33 (see FIG. 4), a gear cover 34 (see FIG. 5), a lever 35 (see FIG. 5), and a stopper 36 (see FIG. 5).

2.1 Toner Frame 21

As illustrated in FIG. 1, the toner frame 21 has the toner storing chamber 15 and the waste toner storing chamber 16. As illustrated in FIG. 3, the toner frame 21 extends in the axial line direction. The toner frame 21 has a tubular shape. The toner frame 21 has one side surface S1 and the other side surface S2 in the axial line direction. Furthermore, the toner frame 21 has an upstream end E1 and a downstream end E2 in the mounting direction of the toner cartridge 3 with respect to the drum cartridge 2.

In addition, the toner frame 21 has a protruding part 21A. The protruding part 21A protrudes from the other side surface S2. The protruding part 21A extends in the axial line direction. An inner space of the protruding part 21A communicates with an inner space of the waste toner storing chamber 16. As illustrated in FIG. 2, the protruding part 21A has the socket 42, a shutter 44, and a spring 43.

In the state where the toner cartridge 3 is mounted on the drum cartridge 2, the nozzle 11 of the waste toner conveyance tube 8 is inserted into the socket 42. The socket 42 is positioned inside the protruding part 21A. The socket 42 extends in the mounting direction. The socket 42 has a tubular shape. The socket 42 has the opening 42A.

The opening 42A communicates with the opening 11A of the nozzle 11 in the state where the nozzle 11 of the waste toner conveyance tube 8 is inserted into the socket 42. In this way, waste toner discharged from the opening 11A of the nozzle 11 is stored in the protruding part 21A via the opening 42A. The waste toner stored in the protruding part 21A is conveyed to the waste toner storing chamber 16 by the screw 28.

The shutter 44 is positioned inside the socket 42. The shutter 44 is movable between an opened position (see FIG. 2) at which the opening 42A is opened and a closed position (not illustrated) at which the opening 42A is closed, with respect to the opening 42A.

The spring 43 presses the shutter 44 positioned at the opened position toward the closed position. When the toner cartridge 3 is mounted on the drum cartridge 2, the shutter 44 is positioned at the opened position from the closed position against the pressing force of the spring 43 due to contact with the nozzle 11. When the toner cartridge 3 is detached from the drum cartridge 2, the shutter 44 is positioned at the closed position from the opened position by the pressing force of the spring 43.

2.2 First Connection Part 22

As illustrated in FIG. 1, the first connection part 22 is connected to the second connection part 65 of the drum cartridge 2 when the toner cartridge 3 is mounted on the drum cartridge 2. The second connection part 65 will be described later. The first connection part 22 is connected to the second connection part 65 and thus is connected to the developing unit 6. As illustrated in FIG. 3, the first connection part 22 is positioned at the downstream end E2 of the toner frame 21. The first connection part 22 protrudes from the downstream end E2 of the toner frame 21. The first connection part 22 is positioned near the one side surface S1 with respect to the other side surface S2 of the toner frame 21 in the axial line direction. The first connection part 22 has a cylindrical shape extending along the swing axis A1. An inner space of the first connection part 22 communicates with the toner storing chamber 15.

The first connection part 22 has a discharge port 22A. That is, the toner cartridge 3 has the discharge port 22A. The discharge port 22A is positioned at the downstream end of the toner cartridge 3 in the mounting direction of the toner cartridge 3 with respect to the drum cartridge 2. The discharge port 22A can discharge toner. As illustrated in FIG. 1, in the state where the toner cartridge 3 is mounted on the drum cartridge 2, the first shutter 23 is positioned at the opened position, and a second shutter 53 is positioned at the opened position, the discharge port 22A communicates with a receiving port 69 of the developing unit 6. The second shutter 53 and the receiving port 69 will be described later.

2.3 First Shutter 23

As illustrated in FIG. 1 and FIG. 5, the first shutter 23 is movable between a closed position (see FIG. 5) at which the discharge port 22A is closed and an opened position (see FIG. 1) at which the discharge port 22A is opened, with respect to the discharge port 22A. When moving between the closed position and the opened position, the first shutter 23 moves along a peripheral surface of the first connection part 22. When moving between the closed position and the opened position, the first shutter 23 moves around the swing axis A1 in the swing direction of the developing unit 6. The first shutter 23 extends along the peripheral surface of the first connection part 22. The first shutter 23 is an arc-like plate. Furthermore, the first shutter 23 extends in the axial line direction.

2.4 Disks 24A and 24B

As illustrated in FIG. 3 and FIG. 5, the disk 24A connects the first shutter 23 and the first connection part 22. The disk 24A is attached at one end of the first connection part 22 in the axial line direction. The disk 24A is rotatable with respect to the first connection part 22. The disk 24A is connected to one end of the first shutter 23 in the axial line direction. In this way, when the disk 24A rotates with respect to the first connection part 22, the first shutter 23 moves along the peripheral surface of the first connection part 22. The disk 24A has a protrusion 37A. That is, the toner cartridge 3 includes the protrusion 37A.

The protrusion 37A is fitted to a concave part 54A (see FIG. 8) of a first disk 54 in the state where the toner cartridge 3 is mounted on the drum cartridge 2. The protrusion 37A is a rib. The protrusion 37A protrudes from the disk 24A. In this way, the protrusion 37A is movable with respect to the discharge port 22A together with the first shutter 23. The protrusion 37A protrudes in the axial line direction. The protrusion 37A extends in a radial direction of the first connection part 22. The protrusion 37A extends in the mounting direction of the toner cartridge 3 with respect to the drum cartridge 2 in the state where the first shutter 23 is positioned at the closed position. That is, the rib extends in the mounting direction of the toner cartridge 3 with respect to the drum cartridge 2. In this way, when the toner cartridge 3 is mounted on the drum cartridge 2, the protrusion 37A is fitted to the concave part 54A of the first disk 54.

The disk 24B connects the first shutter 23 and the first connection part 22 together with the disk 24A. The disk 24B is positioned on an opposite side of the disk 24A with respect to the first connection part 22 in the axial line direction. The disk 24B is attached at the other end of the first connection part 22 in the axial line direction. The disk 24B is rotatable with respect to the first connection part 22. The disk 24B is connected to the other end of the first shutter 23 in the axial line direction. The disk 24B has the same shape as that of the disk 24A. Since the shape of the disk 24B is the same as that of the disk 24A, a description thereof is omitted.

2.5 Plurality of Agitators 25, 26, and 27

As illustrated in FIG. 1, the agitator 25 is configured to agitate the toner in the toner storing chamber 15. The agitator 25 is positioned inside the toner storing chamber 15.

The agitator 26 is configured to convey the toner in the toner storing chamber 15 toward the first connection part 22. The agitator 26 is positioned inside the toner storing chamber 15. The agitator 26 is positioned between the agitator 25 and the first connection part 22.

The agitator 27 is configured to agitate toner in the first connection part 22. The agitator 27 is positioned inside the first connection part 22.

2.6 Screw 28

As illustrated in FIG. 1 and FIG. 3, the screw 28 is configured to convey toner in the protruding part 21A to the waste toner storing chamber 16. The screw 28 is positioned inside the protruding part 21A and the waste toner storing chamber 16. The screw 28 extends in the axial line direction.

2.7 Gear Train

As illustrated in FIG. 4, the plurality of agitator gears 29, 30, and 31, the idle gear 32, and the screw gear 33 are positioned on the one side surface S1 of the toner frame 21.

The agitator gear 29 is rotatable together with the agitator 25 (see FIG. 3). The agitator gear 29 is attached to a shaft 25A (see FIG. 3) of the agitator 25.

The agitator gear 30 is rotatable together with the agitator 26 (see FIG. 3). The agitator gear 30 is attached to a shaft 26A (see FIG. 3) of the agitator 26. The agitator gear 30 is engaged with the agitator gear 29.

The agitator gear 31 is rotatable together with the agitator 27 (see FIG. 3). The agitator gear 31 is attached to the agitator 27. The agitator gear 31 is positioned spaced apart from the agitator gear 30. In addition, the agitator gear 31 is positioned between the disk 24A (see FIG. 3) and the first connection part 22 in the axial line direction.

The idle gear 32 is positioned between the agitator gear 30 and the agitator gear 31. The idle gear 32 is engaged with the agitator gear 30 and the agitator gear 31.

The screw gear 33 is rotatable together with the screw 28 (see FIG. 3). The screw gear 33 is attached to the screw 28. The screw gear 33 is engaged with the agitator gear 29.

2.8 Gear Cover 34

As illustrated in FIG. 5, the gear cover 34 covers at least the agitator gear 29 (see FIG. 4). Specially, the gear cover 34 covers the agitator gears 29 and 30 (see FIG. 4). As illustrated in FIG. 3, the gear cover 34 is attached to the one side surface S1 of the toner frame 21.

2.9 Lever 35

Figure 6:
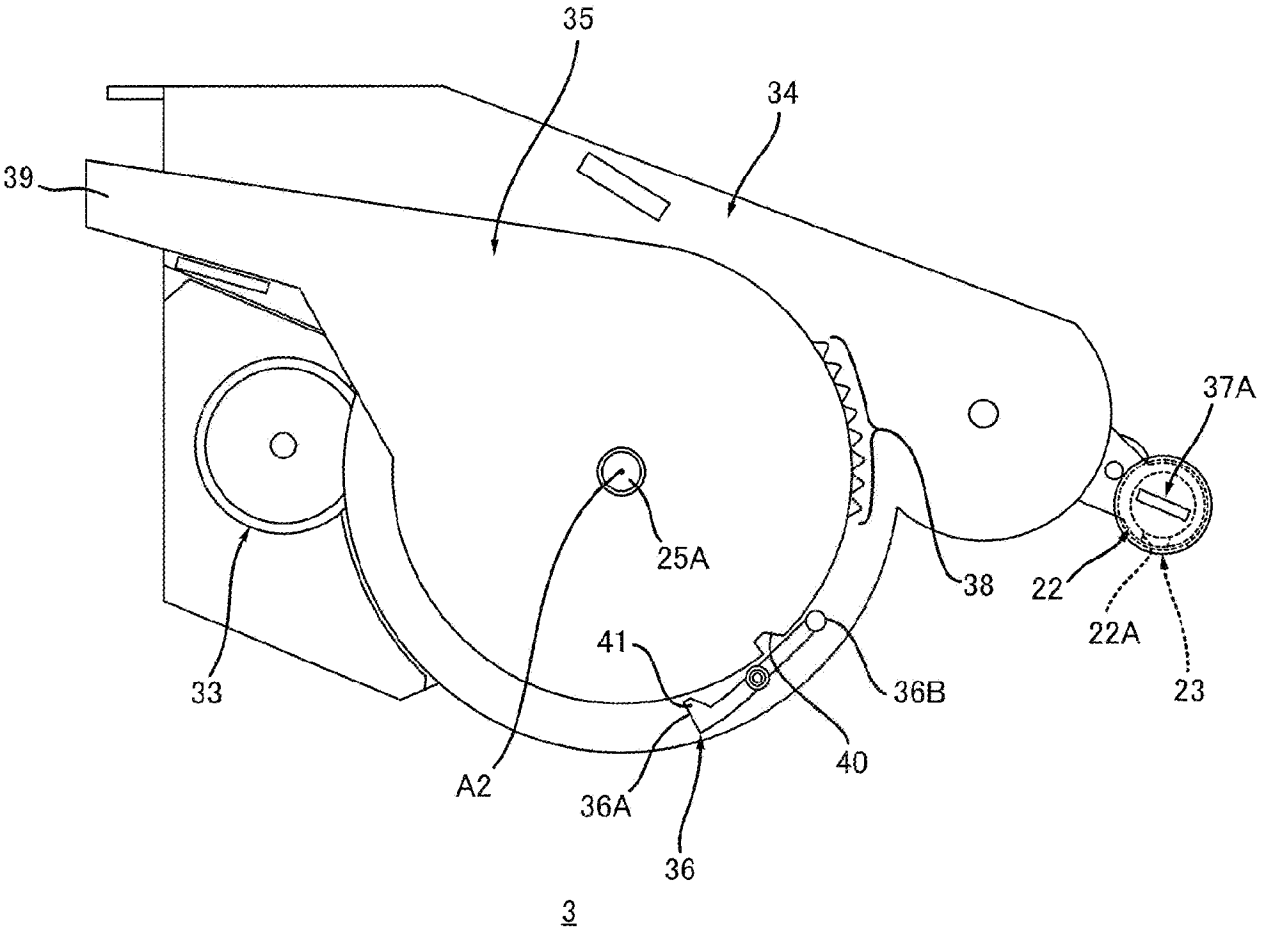
FIG. 6 is a side view of the toner cartridge illustrated in FIG. 3 and illustrates a state in which a lever is positioned at a second position.

As illustrated in FIG. 3 and FIG. 5, the lever 35 is positioned on an opposite side of the toner frame 21 with respect to gear cover 34 in the axial line direction. The lever 35 is attached to the gear cover 34. The lever 35 is positioned separately from the protrusion 37A. Therefore, in the state where the toner cartridge 3 is detached from the drum cartridge 2, even though the lever 35 is operated by a user, the first shutter 23 is not moved. The lever 35 is rotatable with respect to the gear cover 34. Furthermore, the lever 35 is rotatable with respect to the toner frame 21. The lever 35 is rotatable about the shaft 25A of the agitator 25. The lever 35 rotates with respect to the toner frame 21, so that the lever 35 is movable between a first position (see FIG. 5) and a second position (see FIG. 6). As illustrated in FIG. 5, the lever 35 includes a plurality of gear teeth 38 and a handle 39. The lever 35 has a concave part 40.

The plurality of gear teeth 38 are positioned between the shaft 25A of the agitator 25 and the protrusion 37A in the state where the lever 35 is positioned at the first position. The plurality of gear teeth 38 are arranged in a rotation direction of the lever 35. One of the plurality of gear teeth 38 is engaged with one of a plurality of first gear teeth 55A (see FIG. 8) of a second disk 55 in the state where the toner cartridge 3 is mounted on the drum cartridge 2. The plurality of first gear teeth 55A will be described later.

The handle 39 is held by a user when the user moves the lever 35. The handle 39 is positioned on an opposite side of the discharge port 22A with respect to the shaft 25A of the agitator 25 in the state where the lever 35 is positioned at the first position. That is, the handle 39 is positioned on the opposite side of the discharge port 22A with respect to a rotational axis A2 of the lever 35. The handle 39 is positioned on the opposite side of the discharge port 22A with respect to the rotational axis A2 of the lever 35 in the mounting direction.

When the lever 35 is positioned at the first position, a protrusion 41 of the stopper 36 is fitted to the concave part 40. The protrusion 41 will be described later. The concave part 40 is positioned spaced apart from the plurality of gear teeth 38 in the rotation direction of the lever 35.

2.10 Stopper 36

In the state where the toner cartridge 3 is detached from the drum cartridge 2, when the lever 35 is positioned at the first position, the stopper 36 fixes the lever 35 to the first position. The stopper 36 is movable between a fixed position (see FIG. 5) and a release position (see FIG. 6). When the stopper 36 is positioned at the fixed position, the stopper 36 fixes the lever 35 to the first position. When the stopper 36 is positioned at the release position, the stopper 36 releases the fixing of the lever 35. In the state where the toner cartridge 3 is separated from the drum cartridge 2, the stopper 36 is positioned at the fixed position. In the state where the toner cartridge 3 is mounted on the drum cartridge 2, the stopper 36 is positioned at the release position. The stopper 36 is attached to the gear cover 34. The stopper 36 is rotatable with respect to the gear cover 34. The stopper 36 has a rod shape. The stopper 36 has one end 36A and the other end 36B. Furthermore, the stopper 36 has the protrusion 41. The protrusion 41 is positioned between a rotational axis of the stopper 36 and the one end 36A. The protrusion 41 protrudes toward the lever 35. The protrusion 41 is fitted to the concave part 40 of the lever 35 when the stopper 36 is positioned at the fixed position. The stopper 36 positioned at the release position is pressed toward the fixed position by a spring (not illustrated). When the toner cartridge 3 is mounted on the drum cartridge 2, a rib 57 (see FIG. 8) of the drum cartridge 2 contacts the other end 36B, so that the stopper 36 moves from the fixed position to the release position.

3. Details of Drum Cartridge 2

Figure 7:
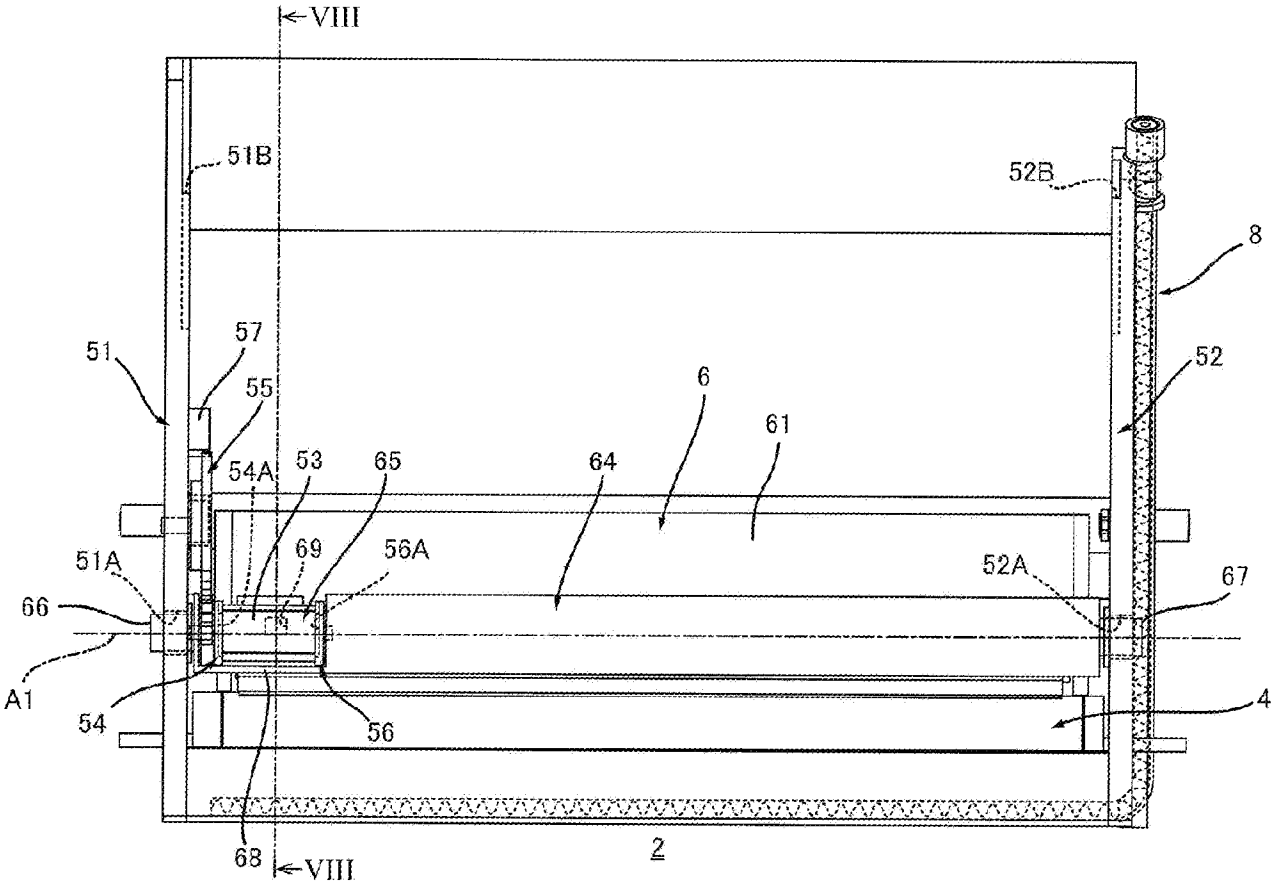
FIG. 7 is a plan view of a drum cartridge illustrated in FIG. 1.

As illustrated in FIG. 7, the drum cartridge 2 includes a first side plate 51, a second side plate 52, the developing unit 6, the second shutter 53, the first disk 54 (see FIG. 8), the second disk 55 (see FIG. 8), and a third disk 56.

3.1 First Side Plate 51 and Second Side Plate 52

The first side plate 51 supports the developing unit 6. The first side plate 51 is positioned on an opposite side of the waste toner conveyance tube 8 with respect to the second side plate 52 in the axial line direction. The first side plate 51 has a hole 51A and a guide 51B. The first side plate 51 includes the rib 57 (see FIG. 8).

To the hole 51A, a boss 66 of the developing unit 6 is fitted. The hole 51A has a circular shape. The hole 51A may be a through-hole.

Figure 8:
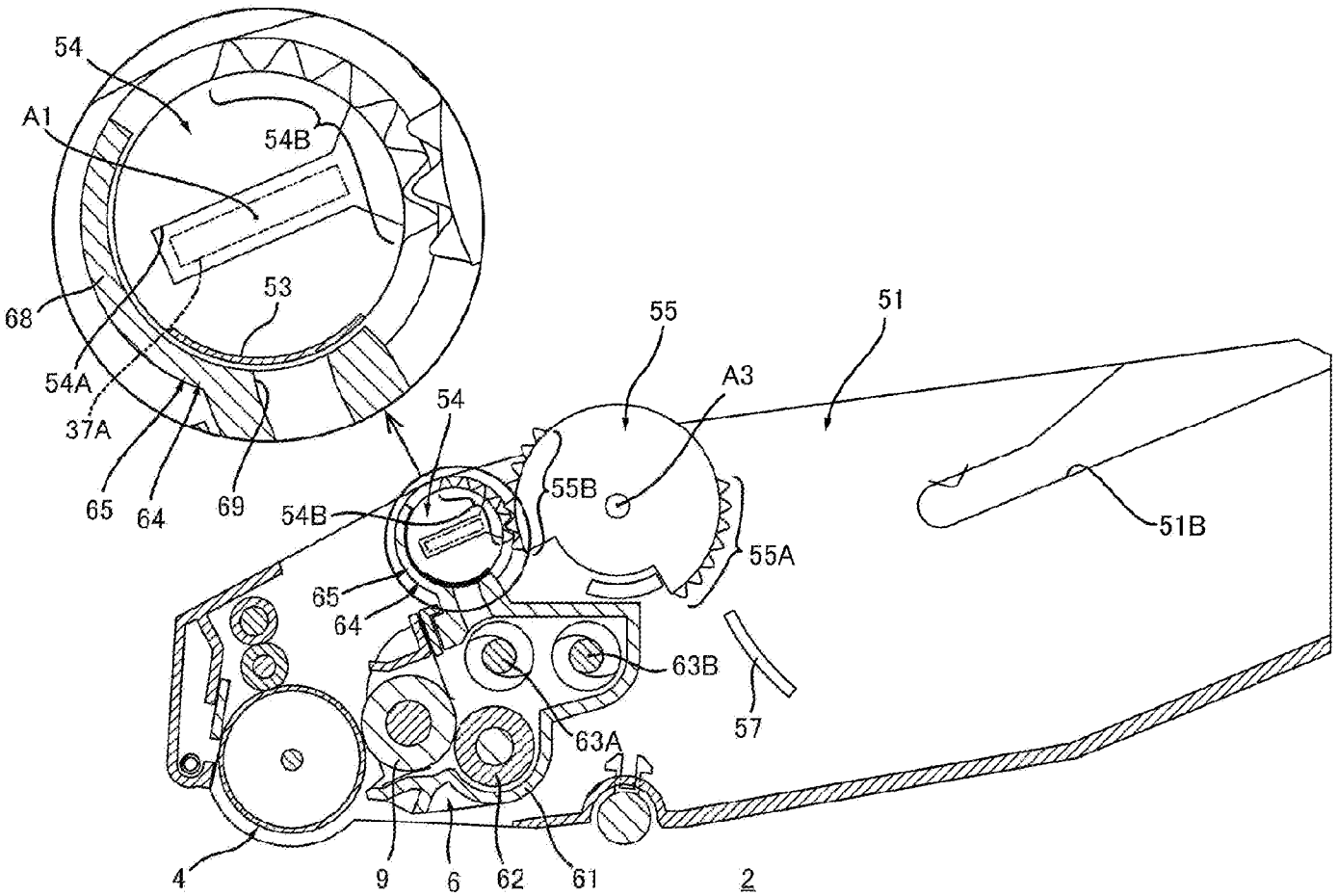
FIG. 8 is a sectional view taken along line VIII-VIII of the drum cartridge illustrated in FIG. 7 and illustrates a state in which a second shutter is positioned at a closed position.

The guide 51B guides the toner cartridge 3 when the toner cartridge 3 is mounted on the drum cartridge 2. As illustrated in FIG. 8, the guide 51B is positioned on an opposite side of the photosensitive drum 4 with respect to the developing unit 6 in the mounting direction of the toner cartridge 3 with respect to the drum cartridge 2. The guide 51B extends in the mounting direction of the toner cartridge 3 with respect to the drum cartridge 2. The guide 51B is a groove. When the toner cartridge 3 is mounted on the drum cartridge 2, a part of the toner cartridge 3 is fitted to the guide 51B. Specifically, when the toner cartridge 3 is mounted on the drum cartridge 2, one end E11 of the shaft 25A (see FIG. 3) of the agitator 25 is fitted to the guide 51B.

The rib 57 contacts the stopper 36 (see FIG. 5) of the toner cartridge 3 when the toner cartridge 3 is mounted on the drum cartridge 2. The rib 57 is positioned between the developing unit 6 and the guide 51B in the mounting direction of the toner cartridge 3 with respect to the drum cartridge 2.

As illustrated in FIG. 7, the second side plate 52 supports the developing unit 6 together with the first side plate 51. The second side plate 52 is positioned spaced apart from the first side plate 51 in the axial line direction. Between the first side plate 51 and the second side plate 52, the toner cartridge 3 is mounted. The second side plate 52 is positioned between the waste toner conveyance tube 8 and the first side plate 51 in the axial line direction. The waste toner conveyance tube 8 is mounted on the second side plate 52. The second side plate 52 has a hole 52A and a guide 52B.

To the hole 52A, a boss 67 of the developing unit 6 is fitted. The hole 52A has a circular shape. The hole 52A may be a through-hole.

The guide 52B guides the toner cartridge 3 together with the guide 51B when the toner cartridge 3 is mounted on the drum cartridge 2. The guide 52B is positioned on an opposite side of the photosensitive drum 4 with respect to the developing unit 6 in the mounting direction of the toner cartridge 3 with respect to the drum cartridge 2. The guide 52B extends in the mounting direction of the toner cartridge 3 with respect to the drum cartridge 2. The guide 52B is a groove. When the toner cartridge 3 is mounted on the drum cartridge 2, a part of the toner cartridge 3 is fitted to the guide 52B. Specifically, when the toner cartridge 3 is mounted on the drum cartridge 2, the other end E12 of the shaft 25A (see FIG. 3) of the agitator 25 is fitted to the guide 52B.

3.2 Developing Unit 6

As illustrated in FIG. 7, the developing unit 6 is arranged between the first side plate 51 and the second side plate 52. The developing unit 6 includes a developing frame 61, a supply roller 62 (see FIG. 8), two screws 63A and 63B (see FIG. 8), a tube 64, and two bosses 66 and 67, in addition to the aforementioned developing roller 9.

3.2.1 Developing Frame 61

The developing frame 61 stores the toner supplied from the toner cartridge 3. Furthermore, the developing frame 61 supports the developing roller 9. The developing frame 61 extends in the axial line direction. The developing frame 61 has a tubular shape. The developing frame 61 is positioned between the first side plate 51 and the second side plate 52 in the axial line direction.

3.2.2 Supply Roller 62

As illustrated in FIG. 8, the supply roller 62 is configured to supply the developing roller 9 with the toner in the developing frame 61. The supply roller 62 is positioned inside the developing frame 61. The supply roller 62 contacts a peripheral surface of the developing roller 9.

3.2.3 Screw 63A and Screw 63B

The screw 63A is configured to convey the toner in the developing frame 61 in the axial line direction. The screw 63A is positioned inside the developing frame 61. The screw 63A extends in the axial line direction. The screw 63A is positioned above the supply roller 62.

The screw 63B is configured to convey the toner in the developing frame 61 in a direction, which is opposite to the direction in which the screw 63A conveys the toner in the developing frame 61, in the axial line direction. The screw 63B is positioned inside the developing frame 61. The screw 63B extends in the axial line direction. The screw 63B is positioned on an opposite side of the developing roller 9 with respect to the screw 63A.

3.2.4 Tube 64

The tube 64 is positioned on an opposite side of the supply roller 62 with respect to the screw 63A. The tube 64 is connected to the developing frame 61. As illustrated in FIG. 7, the tube 64 is positioned between the first side plate 51 and the second side plate 52 in the axial line direction. The tube 64 extends in the axial line direction. The tube 64 extends along the swing axis A1. The tube 64 has a cylindrical shape. The tube 64 has the second connection part 65. That is, the developing unit 6 has the second connection part 65.

The second connection part 65 is connected to the first connection part 22 (see FIG. 3) in the state where the toner cartridge 3 is mounted on the drum cartridge 2. The second connection part 65 is positioned between the first side plate 51 and the second side plate 52 in the axial line direction. That is, the second connection part 65 is connected to the first connection part 22 between the first side plate 51 and the second side plate 52. In this way, the toner cartridge 3 and the developing unit 6 are connected to each other between the first side plate 51 and the second side plate 52. The second connection part 65 is positioned near the first side plate 51 with respect to the second side plate 52 in the axial line direction. The second connection part 65 is a part of the tube 64. The second connection part 65 extends along the swing axis A1. As illustrated in FIG. 8, the second connection part 65 has a wall 68 and the receiving port 69.

As illustrated in FIG. 1, the wall 68 extends along the peripheral surface of the first connection part 22 in the state where the toner cartridge 3 is mounted on the drum cartridge 2. The wall 68 has an arc shape.

The receiving port 69 communicates with an inner space of the developing frame 61. In the state where the toner cartridge 3 is mounted on the drum cartridge 2, the first shutter 23 is positioned at the opened position, and the second shutter 53 is positioned at the opened position, the receiving port 69 communicates with the discharge port 22A of the first connection part 22.

3.2.5 Boss 66 and Boss 67

As illustrated in FIG. 7, the boss 66 is fitted to the hole 51A of the first side plate 51. The boss 66 extends from one end of the developing unit 6 in the axial line direction. The boss 66 extends from one end of the tube 64 in the axial line direction. The boss 66 extends in the axial line direction. The boss 66 extends along the swing axis A1. The boss 66 has a cylindrical shape. The boss 66 is rotatable with respect to the first side plate 51.

The boss 67 is fitted to the hole 52A of the second side plate 52. The boss 67 extends from the other end of the developing unit 6 in the axial line direction. The boss 67 extends from the other end of the tube 64 in the axial line direction. The boss 67 extends in the axial line direction. The boss 67 extends along the swing axis A1. The boss 67 has a cylindrical shape. The boss 67 is rotatable with respect to the second side plate 52.

The boss 66 is fitted to the hole 51A of the first side plate 51 and the boss 67 is fitted to the hole 52A of the second side plate 52, so that the developing unit 6 is supported by the first side plate 51 and the second side plate 52. The boss 66 is rotatable with respect to the first side plate 51 and the boss 67 is rotatable with respect to the second side plate 52, so that the developing unit 6 is swingable with respect to the first side plate 51 and the second side plate 52. The swing axis A1 of the developing unit 6 passes through one end and the other end of the tube 64 in the axial line direction. Furthermore, the swing axis A1 of the developing unit 6 passes through the boss 66 and the boss 67. Preferably, the swing axis A1 passes through the center of the tube 64, the center of the boss 66, and the center of the boss 67.

In addition, the structure, in which the developing unit 6 is swingably supported by the first side plate 51 and the second side plate 52, is not particularly limited. For example, each of the first side plate 51 and the second side plate 52 may have a boss extending in the axial line direction and the developing unit may be swingably supported by the boss of the first side plate 51 and the boss of the second side plate 52.

3.3 Second Shutter 53

Figure 9:
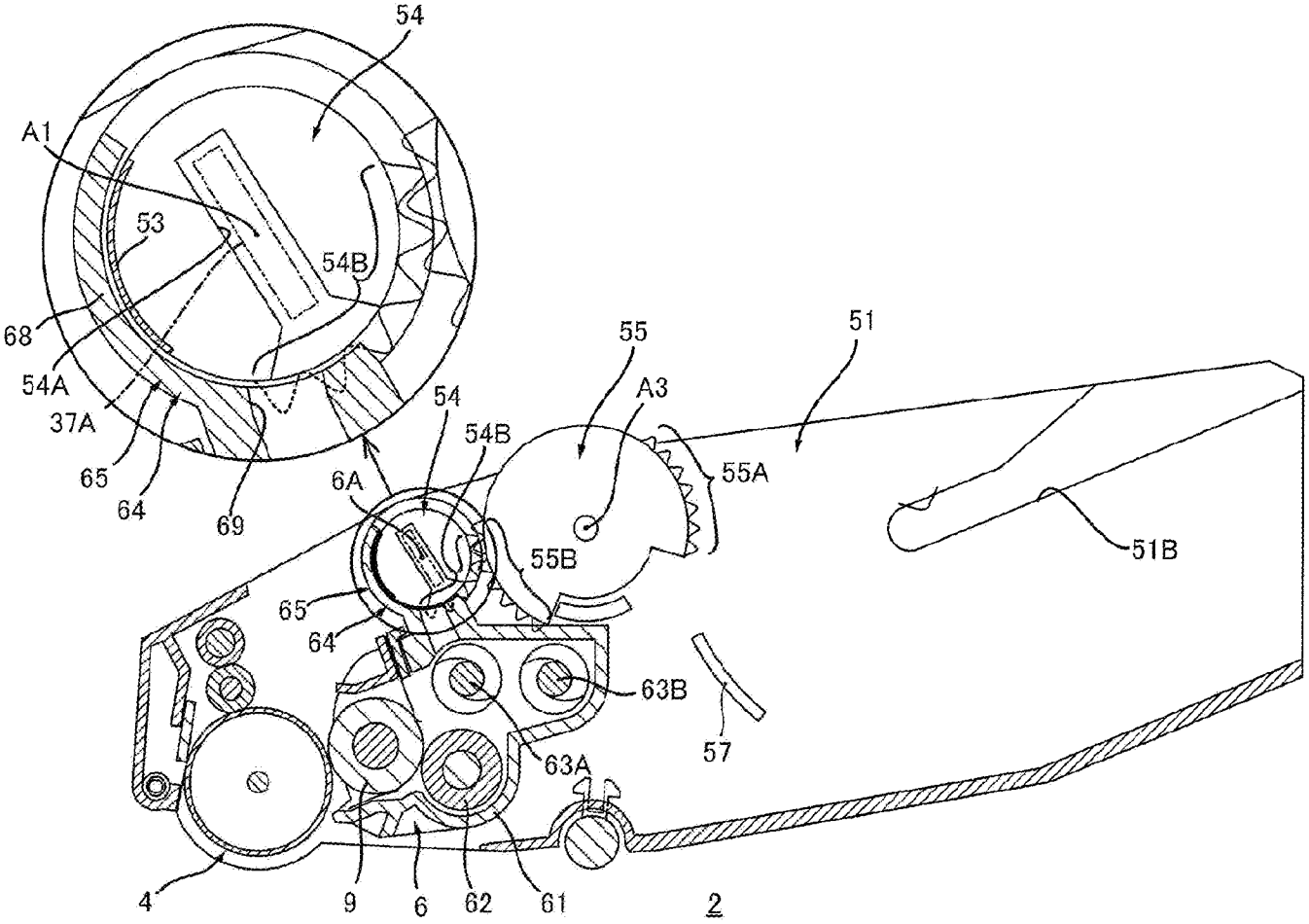
FIG. 9 is a sectional view taken along line VIII-VIII of the drum cartridge illustrated in FIG. 7 and illustrates a state in which a second shutter is positioned at an opened position.

As illustrated in FIG. 7, the second shutter 53 is positioned inside the second connection part 65. The second shutter 53 extends in the axial line direction. As illustrated in FIG. 8 and FIG. 9, the second shutter 53 is rotatable with respect to the receiving port 69 between a closed position (see FIG. 8) at which the receiving port 69 is closed and an opened position (see FIG. 9) at which the receiving port 69 is opened, with respect to the receiving port 69. The second shutter 53 is movable along the wall 68 of the second connection part 65. In this way, when moving between the closed position and the opened position, the second shutter 53 moves around the swing axis A1 in the swing direction of the developing unit 6. Preferably, when moving between the closed position and the opened position, the second shutter 53 rotates about the swing axis A1. The second shutter 53 extends along the wall 68. The second shutter 53 has an arc shape.

3.4 First Disk 54

As illustrated in FIG. 7, the first disk 54 is positioned inside the second connection part 65. The first disk 54 is rotatable with respect to the second connection part 65. The first disk 54 is connected to one end of the second shutter 53 in the axial line direction. In this way, the first disk 54 is also movable with respect to the receiving port 69 together with the second shutter 53. As illustrated in FIG. 8, the first disk 54 has the concave part 54A and a plurality of gear teeth 54B.

When the toner cartridge 3 is mounted on the drum cartridge 2, the protrusion 37A is fitted to the concave part 54A. In this way, in the state where the toner cartridge 3 is mounted on the drum cartridge 2, the first disk 54 is rotatable together with the disk 24A (see FIG. 5) of the toner cartridge 3. When the toner cartridge 3 is detached from the drum cartridge 2 and the second shutter 53 is positioned at the closed position, the concave part 54A extends in the mounting direction of the toner cartridge 3 with respect to the drum cartridge 2. The concave part 54A overlaps the swing axis A1. In other words, the concave part 54A overlaps the rotational axis of the second shutter 53.

The plurality of gear teeth 54B are arranged in a rotation direction of the first disk 54. One of the plurality of gear teeth 54B is engaged with one of a plurality of second gear teeth 55B of the second disk 55. The plurality of second gear teeth 55B will be described later.

3.5 Second Disk 55

The second disk 55 transmits driving force of the lever 35 to the first disk 54 in the state where the toner cartridge 3 is mounted on the drum cartridge 2. The second disk 55 is positioned between the first disk 54 and the guide 51B. The second disk 55 is positioned between the lever 35 (see FIG. 5) and the first disk 54 in the state where the toner cartridge 3 is mounted on the drum cartridge 2. The second disk 55 is attached to the first side plate 51. The second disk 55 is rotatable with respect to the first side plate 51. The second disk 55 has the plurality of first gear teeth 55A and the plurality of second gear teeth 55B.

At least one of the plurality of first gear teeth 55A is positioned between a rotational axis A3 of the second disk 55 and the guide 51B in the state where the toner cartridge 3 is detached from the drum cartridge 2. The plurality of first gear teeth 55A are arranged in a rotation direction of the second disk 55. One of the plurality of first gear teeth 55A is engaged with one of the plurality of gear teeth 38 (see FIG. 5) of the lever 35 when the toner cartridge 3 is mounted on the drum cartridge 2.

The plurality of second gear teeth 55B are positioned spaced apart from the plurality of first gear teeth 55A in the rotation direction of the second disk 55. The plurality of second gear teeth 55B are arranged in the rotation direction of the second disk 55. One of the plurality of second gear teeth 55B is engaged with one of the plurality of gear teeth 54B of the first disk 54.

In the state where the toner cartridge 3 is mounted on the drum cartridge 2, when a user moves the lever 35 from the first position (see FIG. 5) to the second position (see FIG. 6), the second disk 55 rotates and the first disk 54 rotates as illustrated in FIG. 8 and FIG. 9. In this way, the second shutter 53 moves from the closed position (see FIG. 8) to the opened position (see FIG. 9). That is, in the state where the toner cartridge 3 is mounted on the drum cartridge 2, when the lever 35 is positioned at the second position, the lever 35 allows the second shutter 53 (see FIG. 1) to be positioned at the opened position. Furthermore, the disk 24A (see FIG. 5) of the toner cartridge 3 rotates together with the first disk 54, so that the first shutter 23 moves from the closed position (see FIG. 5) to the opened position (see FIG. 1).

Furthermore, in the state where the toner cartridge 3 is mounted on the drum cartridge 2, when a user moves the lever 35 from the second position (see FIG. 6) to the first position (see FIG. 5), the second shutter 53 moves from the opened position (see FIG. 9) to the closed position (see FIG. 8) and the first shutter 23 moves from the opened position (see FIG. 1) to the closed position (see FIG. 5). That is, in the state where the toner cartridge 3 is mounted on the drum cartridge 2, when the lever 35 is positioned at the first position, the lever 35 allows the second shutter 53 to be positioned at the closed position.

3.6 Third Disk 56

As illustrated in FIG. 7, the third disk 56 is positioned inside the second connection part 65. The third disk 56 is positioned spaced apart from the first disk 54 in the axial line direction. The third disk 56 is rotatable with respect to the second connection part 65. The third disk 56 is connected to the other end of the second shutter 53 in the axial line direction. The third disk 56 has the same shape as that of the first disk 54 except that the third disk 56 does not have the gear teeth 54B. When the toner cartridge 3 is mounted on the drum cartridge 2, a protrusion 37B (see FIG. 3) of the toner cartridge 3 is fitted to a concave part 56A of the third disk 56. In this way, in the state where the toner cartridge 3 is mounted on the drum cartridge 2, the third disk 56 is rotatable together with the disk 24B (see FIG. 3) of the toner cartridge 3.

4. Advantages

According to the process cartridge 1, as illustrated in FIG. 2 and FIG. 7, the developing unit 6 is swingable about the virtual swing axis A1 with respect to the photosensitive drum 4.

Therefore, when the photosensitive drum 4 and the developing roller 9 rotate, the developing unit 6 swings about the virtual swing axis A1 with respect to the photosensitive drum 4 so as to hold a proper contact state of the developing roller 9 with respect to the surface of the photosensitive drum 4 without an influence on a deviation of an outer diameter of the developing roller 9.

As a consequence, it is possible to properly hold the contact state of the developing roller 9 with respect to the photosensitive drum 4.

5. Usage Mode of Process Cartridge 1

Figure 10:
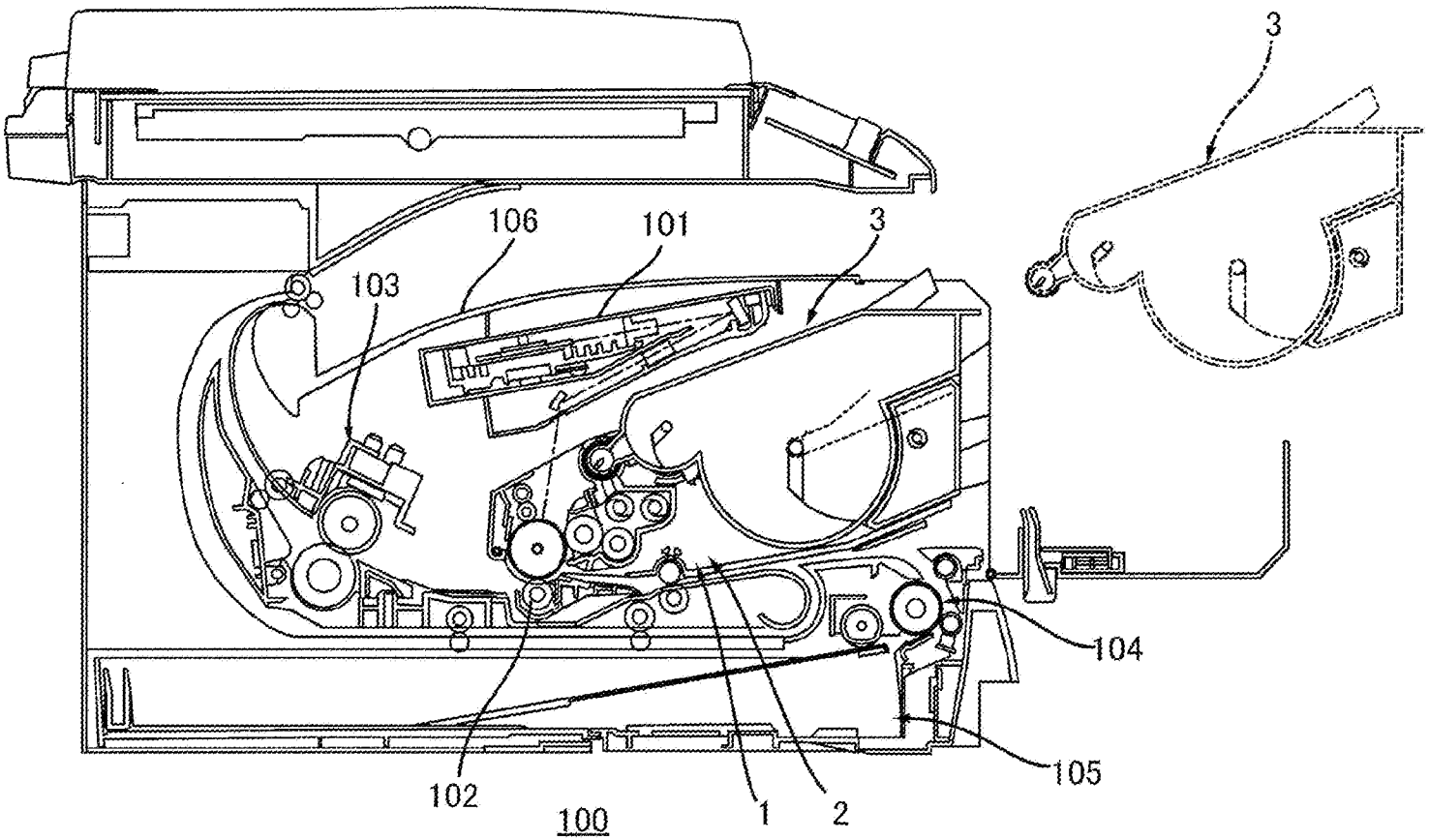
FIG. 10 is an explanatory diagram for explaining a state in which a process cartridge is mounted in an image forming apparatus.

As illustrated in FIG. 10, the process cartridge 1 is mounted in an image forming apparatus 100.

The image forming apparatus 100 includes a laser scan unit 101, a transfer roller 102, a fixing unit 103, a paper feeding unit 104, a paper feeding tray 105, and a paper discharge tray 106. The laser scan unit 101 is configured to expose the surface of the photosensitive drum 4. The transfer roller 102 is configured to transfer a toner image formed on the peripheral surface of the photosensitive drum 4 to paper. The transfer roller 102 contacts the peripheral surface of the photosensitive drum 4. The fixing unit 103 is configured to heat and press the paper with the transferred toner image and to fix the toner image to the paper. The paper feeding unit 104 is configured to supply paper in the paper feeding tray 105 to between the photosensitive drum 4 and the transfer roller 102. The paper feeding tray 105 is configured to store the paper. The paper discharge tray 106 is configured to discharge paper having passed through the fixing unit 103.

Figure 11:
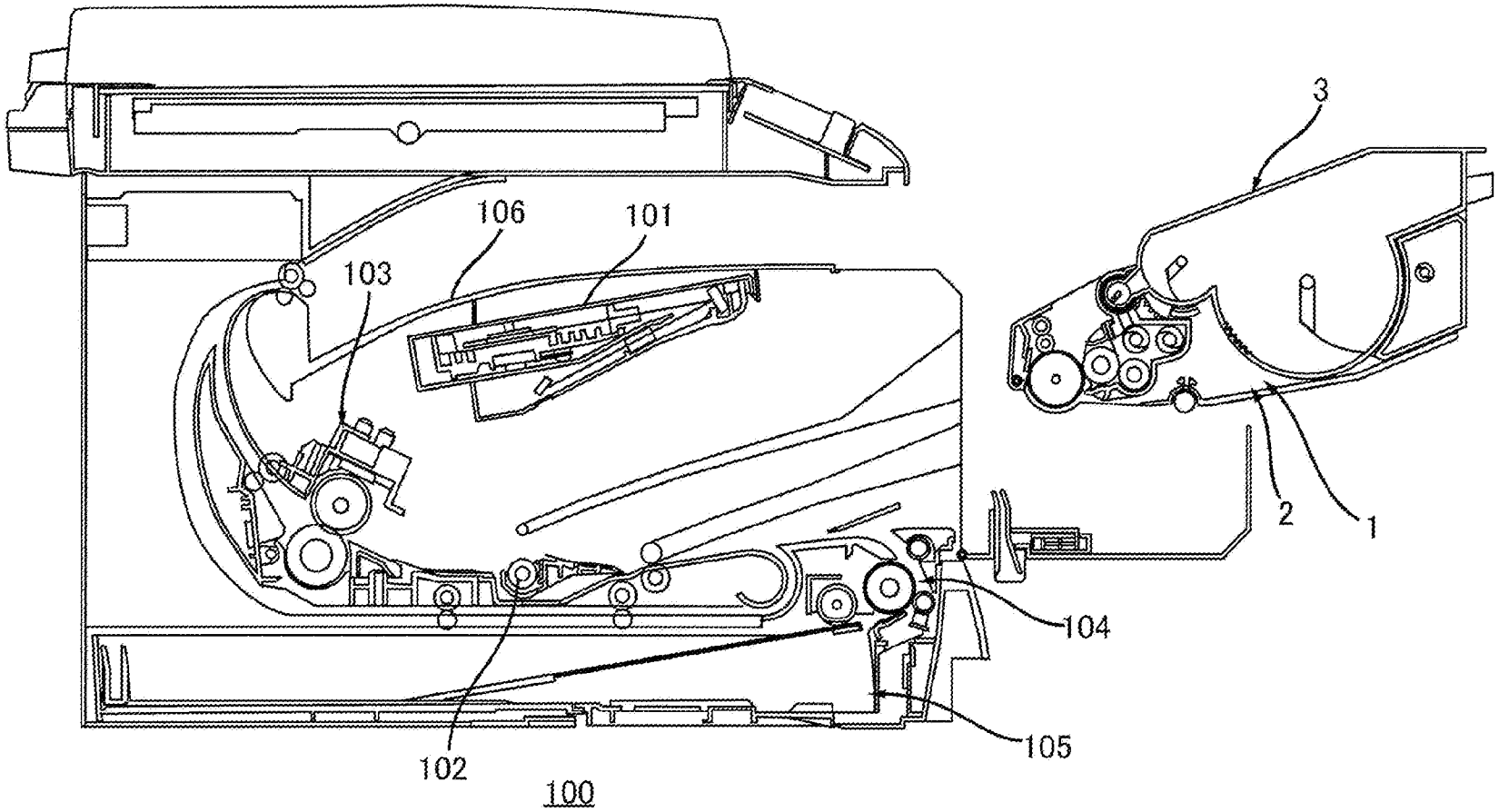
FIG. 11 is an explanatory diagram for explaining a state in which a process cartridge is detached from an image forming apparatus.

In a state where the drum cartridge 2 is mounted in the image forming apparatus 100, the toner cartridge 3 can be detached from the drum cartridge 2. As illustrated in FIG. 11, the toner cartridge 3 can be detached from the image forming apparatus 100 together with the drum cartridge 2.

6. Second Embodiment

Hereinafter, a second embodiment is described. In the second embodiment, the same reference numerals are used to designate elements similar to those of the first embodiment and a description thereof is omitted.

Figure 12:
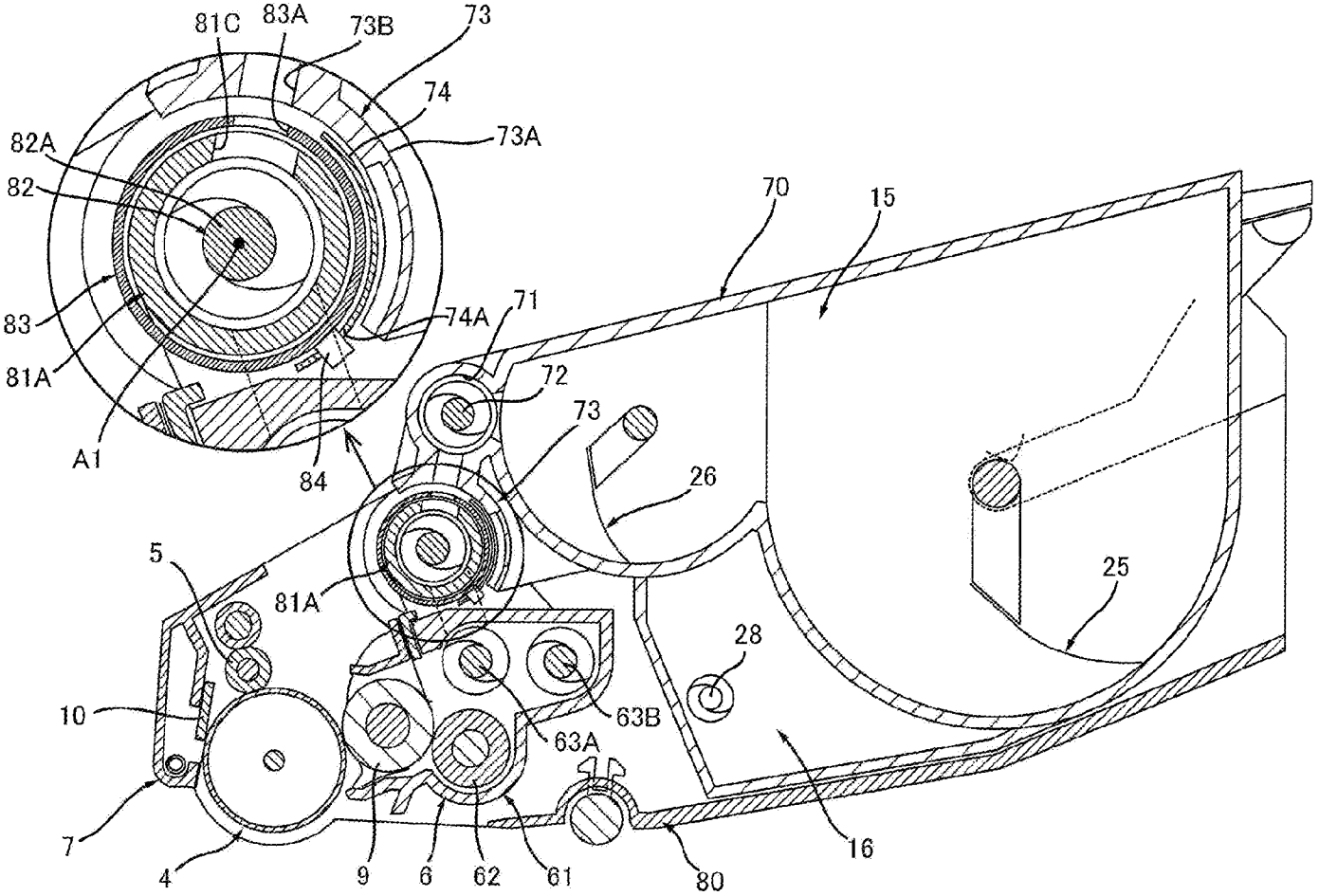
FIG. 12 is a sectional view of a process cartridge of a second embodiment and illustrates a section passing through a discharge port.

As illustrated in FIG. 12, a first connection part 73 of a toner cartridge 70 may have an arc-like wall 73A. A second connection part 81A of a drum cartridge 80 may have a cylindrical shape.

Figure 13:
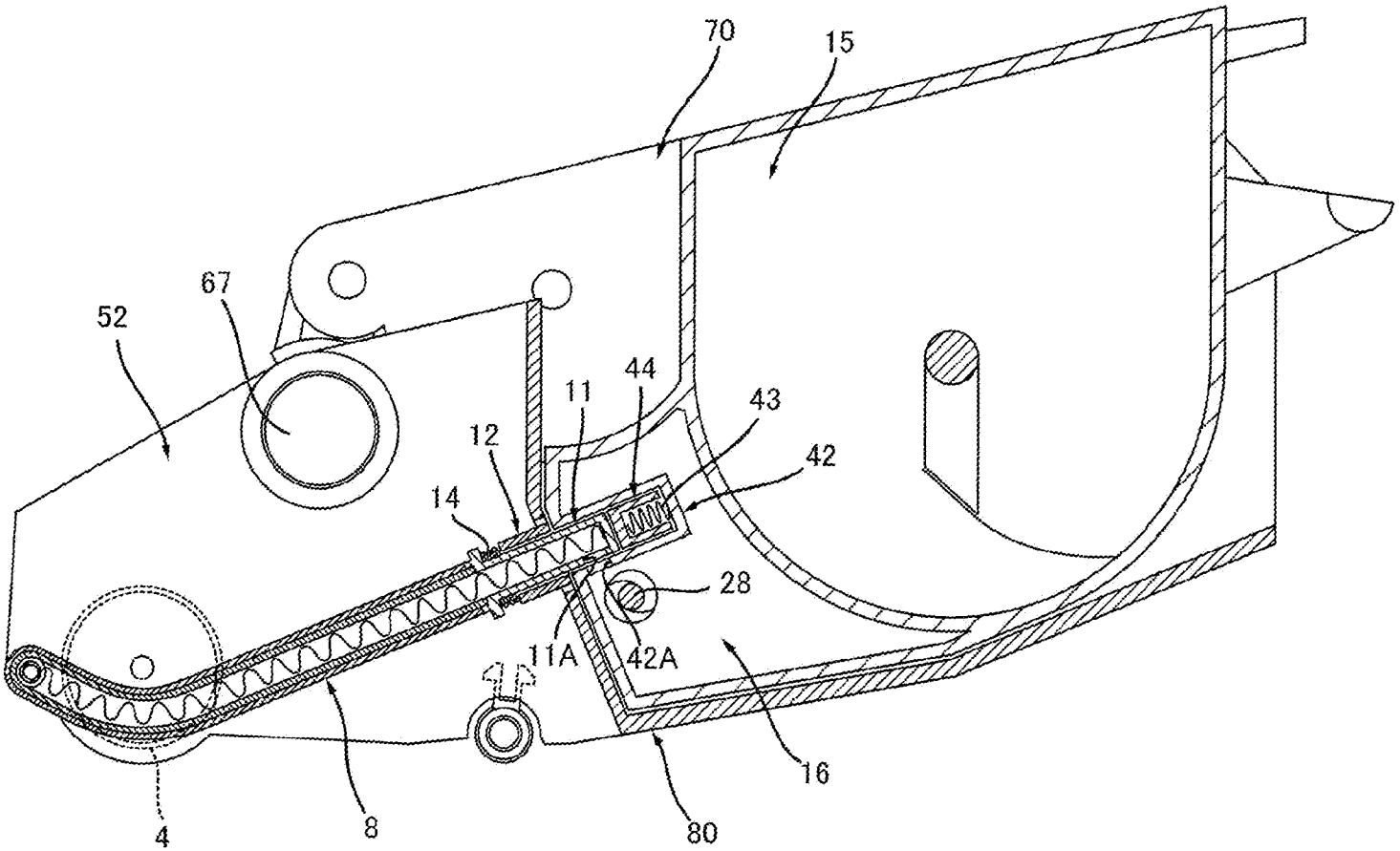
FIG. 13 is a sectional view of the process cartridge illustrated in FIG. 12 and illustrates a section passing through a waste toner conveyance tube.

As illustrated in FIG. 12 and FIG. 13, a waste toner storing chamber 16 of the toner cartridge 70 may be positioned between the toner storing chamber 15 and the developing unit 6 in a state where the toner cartridge 70 is mounted on the drum cartridge 80.

Hereinafter, the toner cartridge 70 and the drum cartridge 80 are described in detail.

6.1 Toner Cartridge 70

As illustrated in FIG. 12, the toner cartridge 70 has a second toner storing chamber 71. Furthermore, the toner cartridge 70 includes an auger screw 72, the first connection part 73, a first shutter 74, a lever 75 (see FIG. 15), and a first disk 76 (see FIG. 15).

6.1.1 Second Toner Storing Chamber 71

As illustrated in FIG. 12, the second toner storing chamber 71 is positioned on an opposite side of the agitator 25 with respect to the agitator 26. The second toner storing chamber 71 communicates with the toner storing chamber 15.

6.1.2 Auger Screw 72

Figure 14:
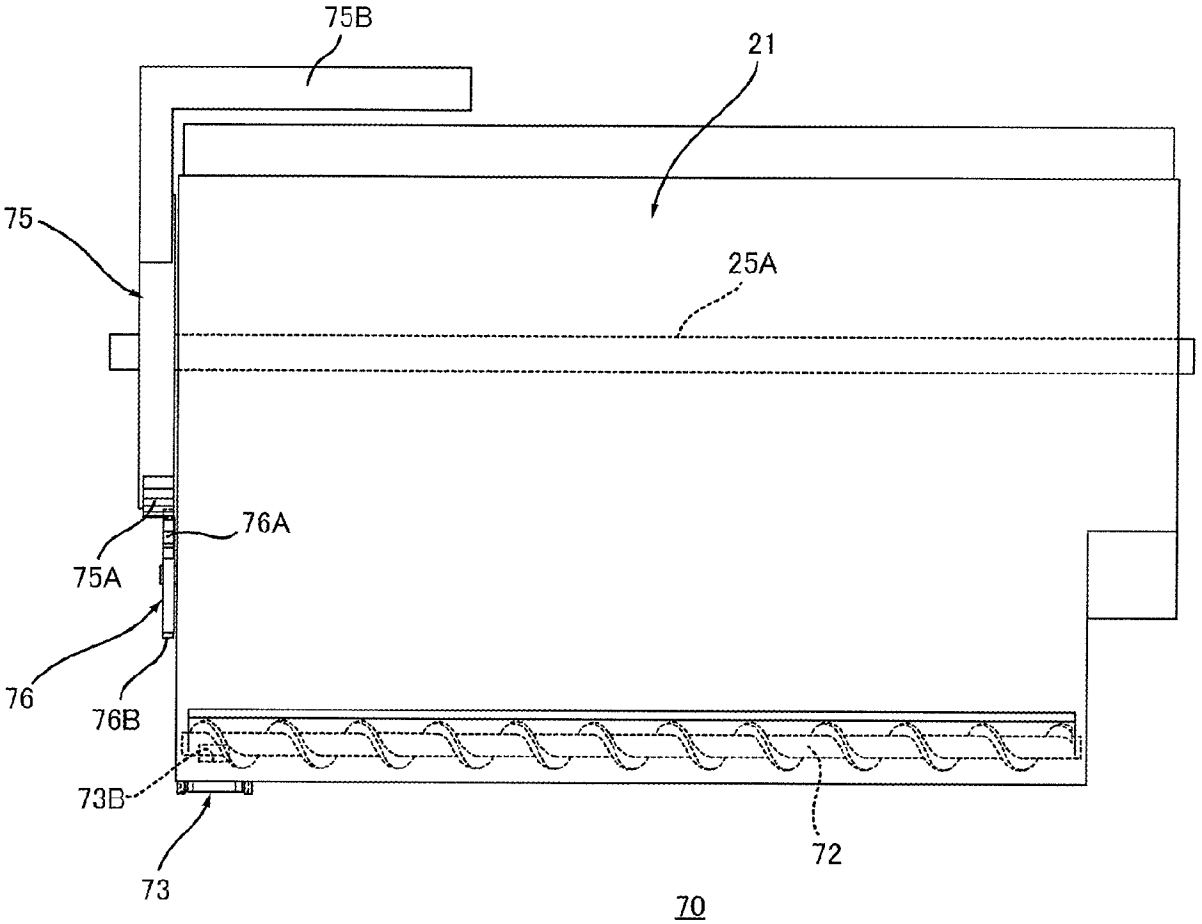
FIG. 14 is a plan view of a toner cartridge illustrated in FIG. 12.

As illustrated in FIG. 12 and FIG. 14, the auger screw 72 conveys, in an axial line direction, toner supplied from the toner storing chamber 15 to the second toner storing chamber 71 by the agitator 26. The auger screw 72 is positioned inside the second toner storing chamber 71. The auger screw 72 extends in the axial line direction.

6.1.3 First Connection Part 73

As illustrated in FIG. 12, the first connection part 73 includes a wall 73A. The first connection part 73 has a discharge port 73B.

The wall 73A extends along a peripheral surface of the second connection part 81A in the state where the toner cartridge 70 is mounted on the drum cartridge 80. The wall 73A has an arc shape.

The discharge port 73B communicates with the second toner storing chamber 71. In the state where the toner cartridge 70 is mounted on the drum cartridge 80, the first shutter 74 is positioned at an opened position, and a second shutter 83 is positioned at the opened position, the discharge port 73B communicates with a receiving port 81C. The receiving port 81C and the second shutter 83 will be described later.

6.1.4 First Shutter 74

The first shutter 74 is movable between a closed position (see FIG. 15) at which the discharge port 73B is closed and an opened position (see FIG. 12) at which the discharge port 73B is opened, with respect to the discharge port 73B. The first shutter 74 is attached to the first connection part 73. When moving between the closed position and the opened position, the first shutter 74 moves along the wall 73A of the first connection part 73. In this way, in the state where the toner cartridge 70 is mounted on the drum cartridge 80, when moving between the closed position and the opened position, the first shutter 74 moves around the swing axis A1 in the swing direction of the developing unit 6. The first shutter 74 extends along the wall 73A of the first connection part 73. The first shutter 74 has an arc shape. The first shutter 74 has a hole 74A. In the state where the toner cartridge 70 is mounted on the drum cartridge 80, a protrusion 84 of the second shutter 83 is fitted to the hole 74A.

6.1.5 Lever 75

Figure 15:
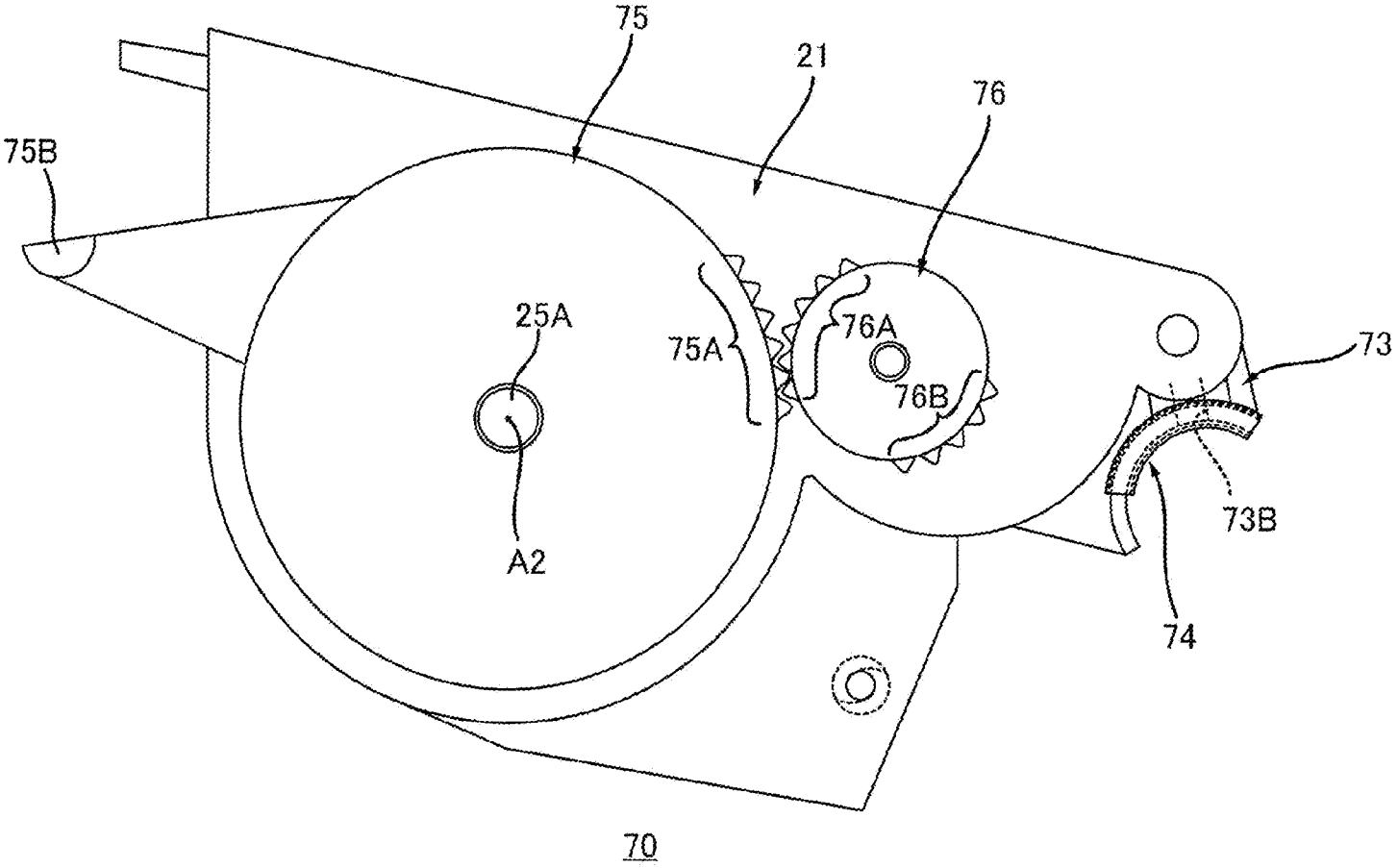
FIG. 15 is a side view of the toner cartridge illustrated in FIG. 14.

As illustrated in FIG. 15, the lever 75 is attached to the toner frame 21. The lever 75 is rotatable with respect to the toner frame 21. The lever 75 is rotatable about the shaft 25A of the agitator 25. The lever 75 rotates with respect to the toner frame 21, so that the lever 75 is movable between a first position (see FIG. 17) and a second position (see FIG. 18). The lever 75 has a plurality of gear teeth 75A and a handle 75B.

The plurality of gear teeth 75A are positioned between the shaft 25A of the agitator 25 and the first shutter 74 in a state where the lever 75 is positioned at the first position. The plurality of gear teeth 75A are arranged in a rotation direction of the lever 75. One of the plurality of gear teeth 75A is engaged with one of a plurality of first gear teeth 76A of the first disk 76. The plurality of first gear teeth 76A will be described later.

The handle 75B is held by a user when the user moves the lever 75. The handle 75B is positioned on an opposite side of the discharge port 73B with respect to the shaft 25A of the agitator 25 in the state where the lever 75 is positioned at the first position. That is, the handle 75B is positioned on the opposite side of the discharge port 73B with respect to a rotational axis A2 of the lever 75. The handle 75B is positioned on the opposite side of the discharge port 73B with respect to the rotational axis A2 of the lever 75 in the mounting direction.

6.1.6 First Disk 76

The first disk 76 transmits driving force of the lever 75 to a second disk 85 (see FIG. 17) in the state where the toner cartridge 70 is attached to the drum cartridge 80. The second disk 85 will be described later. The first disk 76 is positioned between the lever 75 and the first shutter 74. The first disk 76 is positioned between the lever 75 and the second disk 85 in the state where the toner cartridge 70 is attached to the drum cartridge 80. The first disk 76 is positioned spaced apart from the first shutter 74. The first disk 76 is attached to the toner frame 21. The first disk 76 is rotatable with respect to the toner frame 21. The first disk 76 has the plurality of first gear teeth 76A and a plurality of second gear teeth 76B.

One of the plurality of first gear teeth 76A is engaged with one of the plurality of gear teeth 75A of the lever 75.

The plurality of second gear teeth 76B are positioned spaced apart from the first gear teeth 76A in a rotation direction of the first disk 76. One of the plurality of second gear teeth 76B is engaged with one of a plurality of third gear teeth 85A (see FIG. 17) of the second disk 85 in the state where the toner cartridge 70 is attached to the drum cartridge 80. The plurality of third gear teeth 85A will be described later. The plurality of second gear teeth 76B are not engaged with the plurality of gear teeth 75A of the lever 75.

6.2 Drum Cartridge 80

Figure 16:
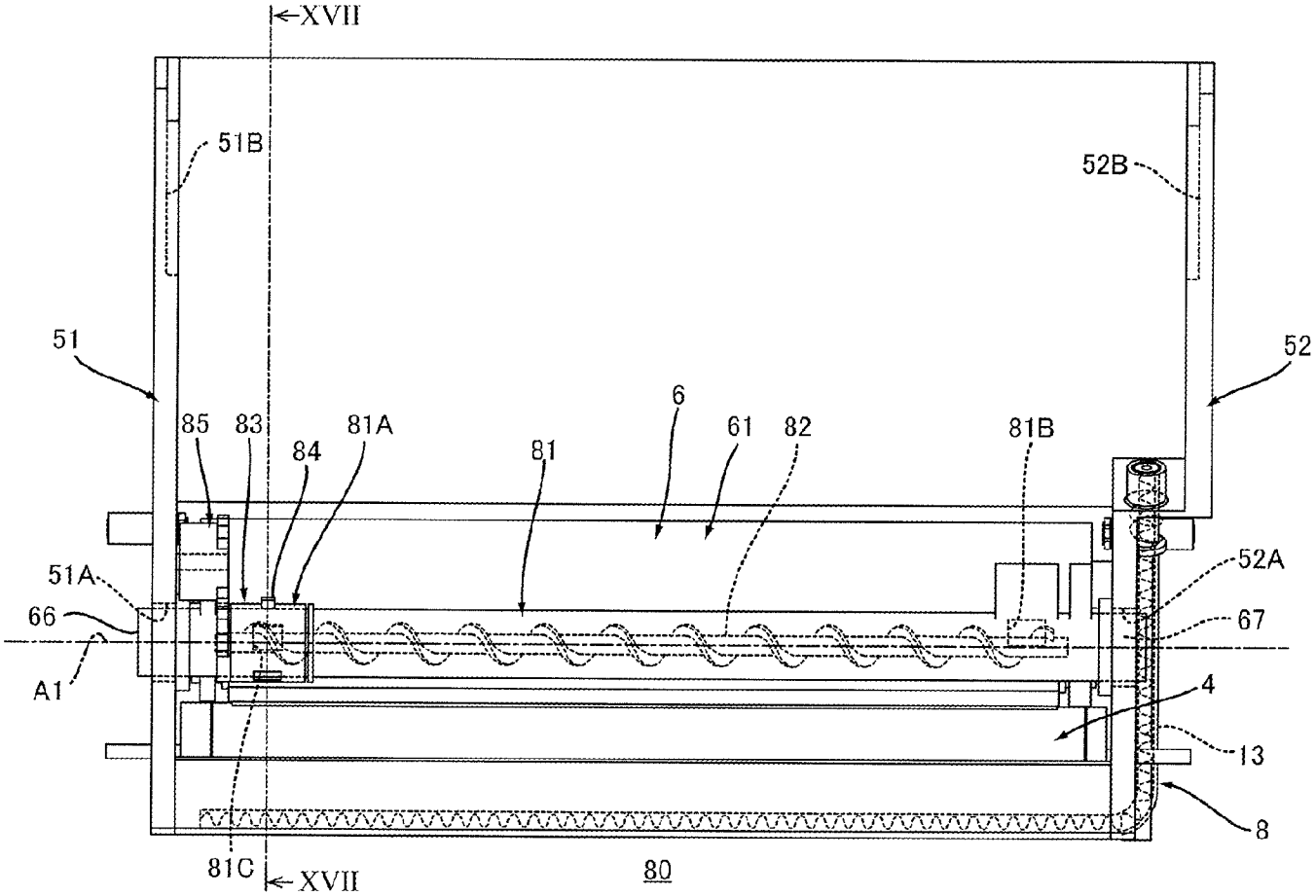
FIG. 16 is a plan view of a drum cartridge illustrated in FIG. 12.
Figure 17:
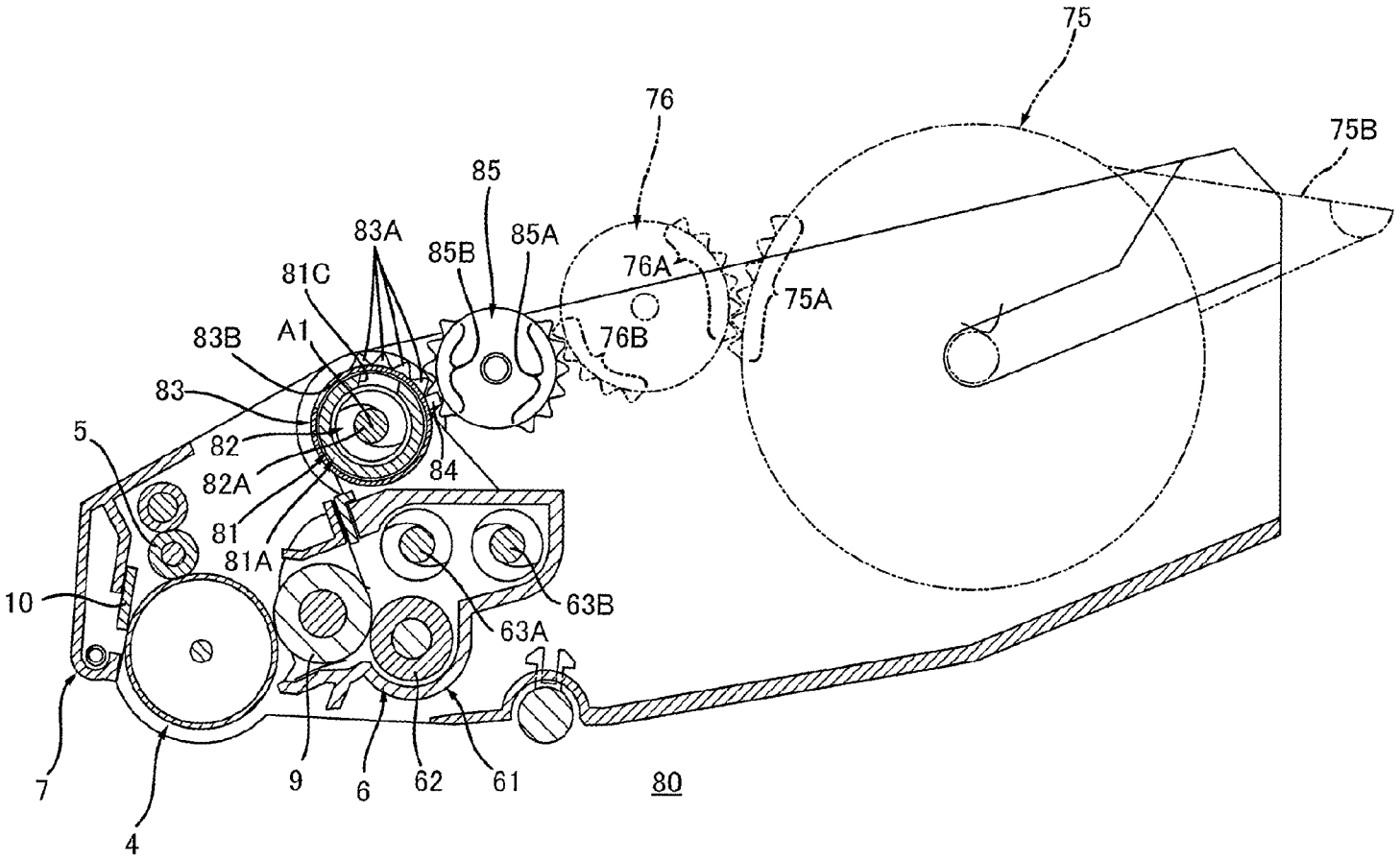
FIG. 17 is a sectional view taken along line XVII-XVII of the drum cartridge illustrated in FIG. 16 and illustrates a state in which a second shutter is positioned at a closed position.
Figure 18:
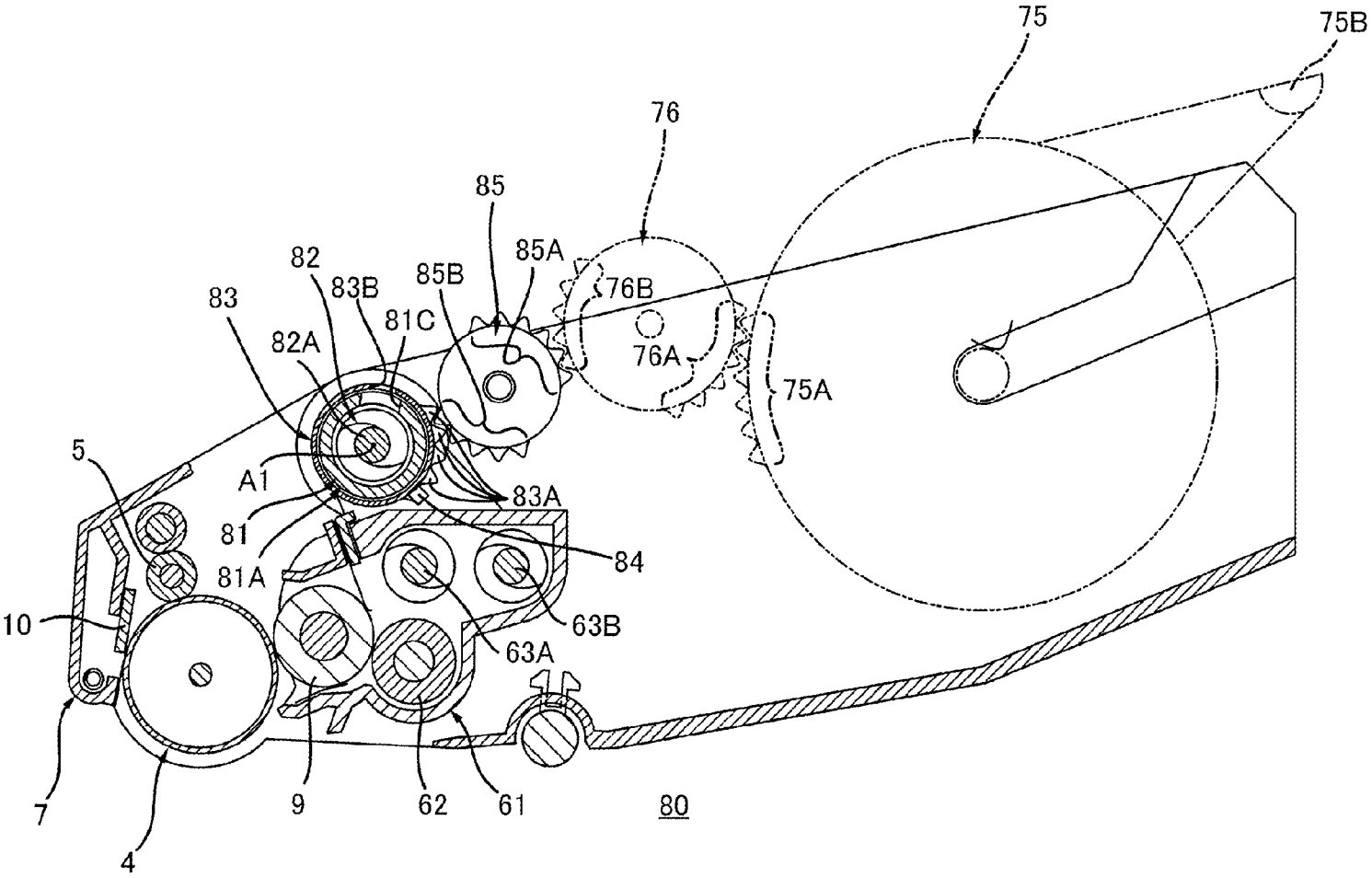
FIG. 18 is a sectional view taken along line XVII-XVII of the drum cartridge illustrated in FIG. 16 and illustrates a state in which the second shutter is positioned at an opened position.

As illustrated in FIG. 16 and FIG. 17, the drum cartridge 80 includes a tube 81, a screw auger 82, the second shutter 83, the protrusion 84, and the second disk 85.

6.2.1 Tube 81

The tube 81 is positioned on an opposite side of the supply roller 62 with respect to the screw 63A, similarly to the tube 64 of the first embodiment. The tube 81 is connected to the developing frame 61. The tube 81 is positioned between the first side plate 51 and the second side plate 52 in the axial line direction. The tube 81 extends in the axial line direction. The tube 81 has a cylindrical shape. The tube 81 has the second connection part 81A and an opening 81B. That is, the developing unit 6 has the second connection part 81A.

The second connection part 81A is connected to the first connection part 73 (see FIG. 14) in the state where the toner cartridge 70 is mounted on the drum cartridge 80. The second connection part 81A is a part of the tube 81. The second connection part 81A extends along the swing axis A1. The second connection part 81A has a cylindrical shape. The second connection part 81A is positioned between the first side plate 51 and the second side plate 52 in the axial line direction. That is, the second connection part 81A is connected to the first connection part 73 between the first side plate 51 and the second side plate 52. In this way, the toner cartridge 70 and the developing unit 6 are connected to each other between the first side plate 51 and the second side plate 52. The second connection part 81A is positioned near the first side plate 51 with respect to the second side plate 52 in the axial line direction. The second connection part 81A has the receiving port 81C.

The receiving port 81C communicates with an inner space of the second connection part 81A. As illustrated in FIG. 12, in the state where the toner cartridge 70 is mounted on the drum cartridge 80, the first shutter 74 is positioned at the opened position, and the second shutter 83 is positioned at the opened position, the receiving port 81C communicates with the discharge port 73B of the first connection part 73.

As illustrated in FIG. 16, the opening 81B communicates with an inner space of the developing frame 61. An inner space of the tube 81 communicates with the inner space of the developing frame 61 via the opening 81B. The opening 81B is positioned spaced apart from the second connection part 81A in the axial line direction. Furthermore, the opening 81B is positioned spaced apart from the receiving port 81C in the axial line direction. The opening 81B is positioned between the first side plate 51 and the second side plate 52 in the axial line direction. The opening 81B is positioned near the second side plate 52 with respect to the first side plate 51 in the axial line direction.

6.2.2 Screw Auger 82

As illustrated in FIG. 16, the screw auger 82 conveys toner supplied inside the tube 81 via the receiving port 81C toward the opening 81B. The screw auger 82 is positioned inside the tube 81. That is, the developing unit 6 has the screw auger 82. The screw auger 82 is positioned inside the second connection part 81A. The screw auger 82 extends in the axial line direction. As illustrated in FIG. 17, a section of a shaft 82A of the screw auger 82, which is perpendicular to the axial line direction, overlaps the swing axis A1 when viewed in the axial line direction.

6.2.3 Second Shutter 83

As illustrated in FIG. 16 and FIG. 17, the second shutter 83 is attached to the second connection part 81A. The second shutter 83 extends in the axial line direction. The second shutter 83 has a cylindrical shape. The second shutter 83 covers the second connection part 81A. The second shutter 83 is movable between an opened position (see FIG. 18) and a closed position (see FIG. 17). The second shutter 83 is rotatable with respect to the second connection part 81A. The second shutter 83 is rotatable along a peripheral surface of the second connection part 81A. Preferably, the second shutter 83 is rotatable about the swing axis A1. The second shutter 83 rotates with respect to the second connection part 81A, so that the second shutter 83 is movable between the opened position and the closed position. The second shutter 83 has a plurality of gear teeth 83A and an opening 83B.

The plurality of gear teeth 83A are positioned on a peripheral surface of the second shutter 83. The plurality of gear teeth 83A are arranged in a rotation direction of the second shutter 83. One of the plurality of gear teeth 83A is engaged with one of a plurality of fourth gear teeth 85B of the second disk 85. The plurality of fourth gear teeth 85B will be described later.

The opening 83B overlaps the receiving port 81C when the second shutter 83 is positioned at the opened position. The opening 83B does not overlap the receiving port 81C when the second shutter 83 is positioned at the closed position.

6.2.4 Protrusion 84

The protrusion 84 is positioned on the peripheral surface of the second shutter 83. The protrusion 84 protrudes from the peripheral surface of the second shutter 83. In this way, the protrusion 84 is movable with respect to the receiving port 81C together with the second shutter 83. The protrusion 84 is fitted to the hole 74A (see FIG. 12) of the first shutter 74 when the toner cartridge 70 is mounted on the drum cartridge 80. In this way, in the state where the toner cartridge 70 is mounted on the drum cartridge 80, the first shutter 74 and the second shutter 83 are all movable. The protrusion 84 is a boss. The protrusion 84 extends in the mounting direction of the toner cartridge 70 with respect to the drum cartridge 80 in the state where the second shutter 83 is positioned at the closed position. In this way, when the toner cartridge 70 is mounted on the drum cartridge 80, the protrusion 84 is fitted to the hole 74A of the first shutter 74.

6.2.5 Second Disk 85

The second disk 85 transmits driving force of the first disk 76 to the second shutter 83 in the state where the toner cartridge 70 is attached to the drum cartridge 80. The second disk 85 is positioned between the first disk 76 and the second shutter 83 in the state where the toner cartridge 70 is attached to the drum cartridge 80. The second disk 85 is attached to the first side plate 51. The second disk 85 is rotatable with respect to the first side plate 51. The second disk 85 has the plurality of third gear teeth 85A and a plurality of fourth gear teeth 85B.

One of the plurality of third gear teeth 85A is engaged with one of the plurality of second gear teeth 76B of the first disk 76 when the toner cartridge 70 is mounted on the drum cartridge 80.

The plurality of fourth gear teeth 85B are positioned spaced apart from the plurality of third gear teeth 85A in a rotation direction of the second disk 85. One of the plurality of fourth gear teeth 85B is engaged with one of the plurality of gear teeth 83A of the second shutter 83.

In the state where the toner cartridge 70 is mounted on the drum cartridge 80, when a user moves the lever 75 from the first position (see FIG. 17) to the second position (see FIG. 18), the first disk 76 rotates and the second disk 85 rotates. In this way, the second shutter 83 moves from the closed position (see FIG. 17) to the opened position (see FIG. 18). That is, in the state where the toner cartridge 70 is mounted on the drum cartridge 80, when the lever 75 is positioned at the first position, the lever 75 allows the second shutter 83 to be positioned at the closed position. Furthermore, the first shutter 74 rotates together with the second shutter 83 and thus moves from the closed position (see FIG. 15) to the opened position (see FIG. 12).

Furthermore, in the state where the toner cartridge 70 is mounted on the drum cartridge 80, when a user moves the lever 75 from the second position (see FIG. 18) to the first position (see FIG. 17), the second shutter 83 moves from the opened position (see FIG. 18) to the closed position (see FIG. 17) and the first shutter 74 moves from the opened position (see FIG. 12) to the closed position (see FIG. 15). That is, in the state where the toner cartridge 70 is mounted on the drum cartridge 80, when the lever 75 is positioned at the second position, the lever 75 allows the second shutter 83 to be positioned at the opened position.

6.3 Advantages of Second Embodiment

Also in the second embodiment, it is possible to obtain advantages similar to those of the first embodiment.

As described above with respect to the embodiments, a process cartridge according to the present disclosure includes a drum cartridge including a photosensitive drum and a toner cartridge which is mountable on the drum cartridge and is able to store toner.

The drum cartridge includes a cleaner, a waste toner conveyance tube, and a developing unit.

The cleaner is configured to collect waste toner on the photosensitive drum.

The waste toner conveyance tube is configured to convey the waste toner collected by the cleaner.

The developing unit includes a developing roller. The developing unit is swingable about a swing axis with respect to the photosensitive drum. The developing roller is configured to supply toner to the photosensitive drum.

The toner cartridge has a waste toner storing chamber for storing the waste toner conveyed by the waste toner conveyance tube.

According to such a configuration, when the photosensitive drum and the developing roller rotate, the developing unit swings about a virtual swing axis with respect to the photosensitive drum so as to hold a proper contact state of the developing roller with respect to the surface of the photosensitive drum.

As a consequence, it is possible to properly hold the contact state of the developing roller with respect to the photosensitive drum.

According to the process cartridge of the present disclosure, it is possible to properly hold the contact state of the developing roller with respect to the photosensitive drum.

What is claimed is:

1. An image forming apparatus comprising:

a housing;

a drum cartridge attachable to and detachable from the housing in a first direction, the drum cartridge comprising:

a photosensitive drum;

a developing roller;

a developing frame having a developing chamber for storing toner to be supplied to the photosensitive drum;

a first wall having a toner receiving opening;

a cleaner for collecting waste toner from the photosensitive drum; and a waste toner conveyance tube for conveying the waste toner collected by the cleaner, the waste toner conveyance tube having a waste toner exhausting opening; and a toner cartridge attachable to and detachable from the housing, the toner cartridge comprising:

a toner frame comprising:

a toner chamber for storing toner, the toner chamber communicating with the developing chamber in a state where the drum cartridge and the toner cartridge are attached to the housing;

a waste toner chamber for storing the waste toner to be conveyed by the waste toner conveyance tube; and a waste toner receiving opening communicating with the waste toner exhausting opening in a state where the drum cartridge and the toner cartridge are attached to the housing;

a second wall having a toner supply opening communicating with the toner chamber and the toner receiving opening in a state where the drum cartridge and the toner cartridge are attached to the housing;

a toner shutter rotatable between a first closed position at which the toner shutter closes the toner supply opening and a first opened position at which the toner supply opening is opened; and a lever movable between a first position at which the toner shutter is positioned at the first closed position and a second position at which the toner shutter is positioned at the first opened position, wherein, in a state where the drum cartridge and the toner cartridge are attached to the housing, the waste toner receiving opening is located at a position between the toner supply opening and a part of the lever in the first direction.

2. The image forming apparatus according to claim 1, wherein the first wall has an arc shape.

3. The image forming apparatus according to claim 1, wherein the second wall is a cylindrical wall extending in a second direction in which a rotation axis of the photosensitive drum extends.

4. The image forming apparatus according to claim 1, wherein the drum cartridge comprises a waste toner shutter that is configured to be movable between:

a second closed position at which the waste toner shutter closes the waste toner exhausting opening; and a second opened position at which the exhausting opening is opened, and wherein, in a state where the drum cartridge and the toner cartridge are attached to the housing, the toner shutter is at the first opened position and the waste toner shutter is at the second opened position.

5. The image forming apparatus according to claim 4, wherein the waste toner conveyance tube extends in the first direction, and wherein the waste toner shutter is movable along the waste toner conveyance tube in the first direction between the second closed position and the second opened position.

6. The image forming apparatus according to claim 4, wherein the toner cartridge is attached to and detached from the drum cartridge, and wherein, in a state where the toner cartridge is detached from the drum cartridge, the toner shutter is at the first closed position and the waste toner shutter is at the second closed position.

7. The image forming apparatus according to claim 1, wherein, in a state where the drum cartridge and the toner cartridge are attached to the housing, the waste toner receiving opening is located at a position between the toner supply opening and a furthest edge of the lever from the photosensitive drum in the first direction.

8. The image forming apparatus according to claim 7, wherein the lever has a handle, the handle being configured to be held by a user when the user moves the lever, and wherein the edge is a part of the handle.

9. A toner cartridge attachable to and detachable from a drum cartridge in a first direction, the toner cartridge comprising:

a toner frame comprising:

a toner chamber for storing toner;

a waste toner chamber for storing waste toner to be collected by a cleaner of the drum cartridge, the cleaner collecting the waste toner from a photosensitive drum of the drum cartridge; and a waste toner receiving opening, in a state where the toner cartridge is attached to the drum cartridge, communicating with a waste toner exhausting opening of a waste toner conveyance tube provided in the drum cartridge, the conveyance tube conveying the waste toner collected by the cleaner;

a wall having a toner supply opening communicating with the toner chamber and a toner receiving opening of the drum cartridge in a state where the toner cartridge is attached to the drum cartridge, the toner receiving opening communicating with a developing chamber of the drum cartridge;

a toner shutter rotatable between a closed position at which the toner shutter closes the toner supply opening and an opened position at which the toner supply opening is opened; and a lever movable between a first position at which the toner shutter is positioned at the closed position and a second position at which the toner shutter is positioned at the opened position, wherein, in a state where the toner cartridge is attached to the drum cartridge, the waste toner receiving opening is located at a position between the toner supply opening and a part of the lever in the first direction.

10. The toner cartridge according to claim 9, wherein the wall is a cylindrical wall extending in a second direction in which a rotation axis of the photosensitive drum extends.

11. The toner cartridge according to claim 9, wherein the toner shutter is at the opened position in a state where the toner cartridge is detached from the drum cartridge.

12. The toner cartridge according to claim 9, wherein the toner shutter is at the closed position in a state where the toner cartridge is detached from the drum cartridge.

13. The toner cartridge according to claim 9, wherein, in a state where the toner cartridge is attached to the drum cartridge, the waste toner receiving opening is located at a position between the toner supply opening and a furthest edge of the lever from the photosensitive drum in the first direction.

14. The toner cartridge according to claim 13, wherein the lever has a handle, the handle being configured to be held by a user when the user moves the lever, and wherein the edge is a part of the handle.

* * * * *